US011324332B1

(12) United States Patent
Flannery et al.

(10) Patent No.: US 11,324,332 B1
(45) Date of Patent: May 10, 2022

(54) BED BUMPER APPARATUS

(71) Applicant: Regalo International, LLC, Longboat Key, FL (US)

(72) Inventors: Mark A. Flannery, Longboat Key, FL (US); Kasey L. Pipo, Elko New Market, MN (US); Kyle J. Willette, Savage, MN (US)

(73) Assignee: Regalo International, LLC, Longboat Key, FL (US)

( * ) Notice: Subject to any disclaimer, the term of this patent is extended or adjusted under 35 U.S.C. 154(b) by 1 day.

(21) Appl. No.: 16/692,996

(22) Filed: Nov. 22, 2019

Related U.S. Application Data

(60) Provisional application No. 62/841,853, filed on May 2, 2019.

(51) Int. Cl.
*A47C 21/08* (2006.01)

(52) U.S. Cl.
CPC ..... *A47C 21/08* (2013.01)

(58) Field of Classification Search
CPC .... A47C 21/08; A47D 15/005; A47D 15/008; A45F 3/047
See application file for complete search history.

(56) References Cited

U.S. PATENT DOCUMENTS 2,044,390 A * 6/1936 Kiehs ..... A41B 13/06 128/874
5,530,974 A * 7/1996 Rains ..... A47C 21/08 5/630
6,952,846 B2 10/2005 Flannery et al.
7,137,158 B2 11/2006 Flannery et al.
7,302,720 B2 12/2007 Flannery et al.
7,640,606 B2 1/2010 Flannery et al.
7,913,333 B2 3/2011 Flannery et al.
9,962,009 B2 * 5/2018 Krim ..... A47C 31/105
10,251,465 B2 * 4/2019 Alcantra ..... A45F 3/04
2004/0003469 A1 * 1/2004 Gill-Barajas ..... A47C 21/08 5/636
2005/0060808 A1 * 3/2005 Shaw ..... A47C 20/021 5/649
2007/0124861 A1 * 6/2007 Fellows ..... A47C 20/027 5/630
2008/0163424 A1 * 7/2008 Mobley ..... A47C 21/08 5/426
2015/0245717 A1 * 9/2015 Edmondson ..... A47C 21/08 5/425
2017/0290440 A1 * 10/2017 Haynes ..... A47C 21/08
2017/0295948 A1 * 10/2017 Awshee ..... A47C 20/08
2018/0110342 A1 * 4/2018 Moss ..... A47C 21/08
2019/0082858 A1 * 3/2019 Durant ..... A47D 15/008

* cited by examiner

*Primary Examiner* — Robert G Santos
*Assistant Examiner* — Alison N Labarge

(57) ABSTRACT

The present bed bumper apparatus includes an elongate body that is resilient and flexible, an inner cover enclosing an entirety of the elongate body such that the elongate body is removable from the inner cover only by destroying an integrity of the inner cover, an outer cover enclosing an entirety of the inner cover having the elongate body, and a flexible strap engaged to the outer cover and having a quick release buckle and length adjuster such that the bed bumper can be engaged to a mattress at an edge of the mattress to minimize a person from rolling off the mattress.

2 Claims, 14 Drawing Sheets

FIG. 2A
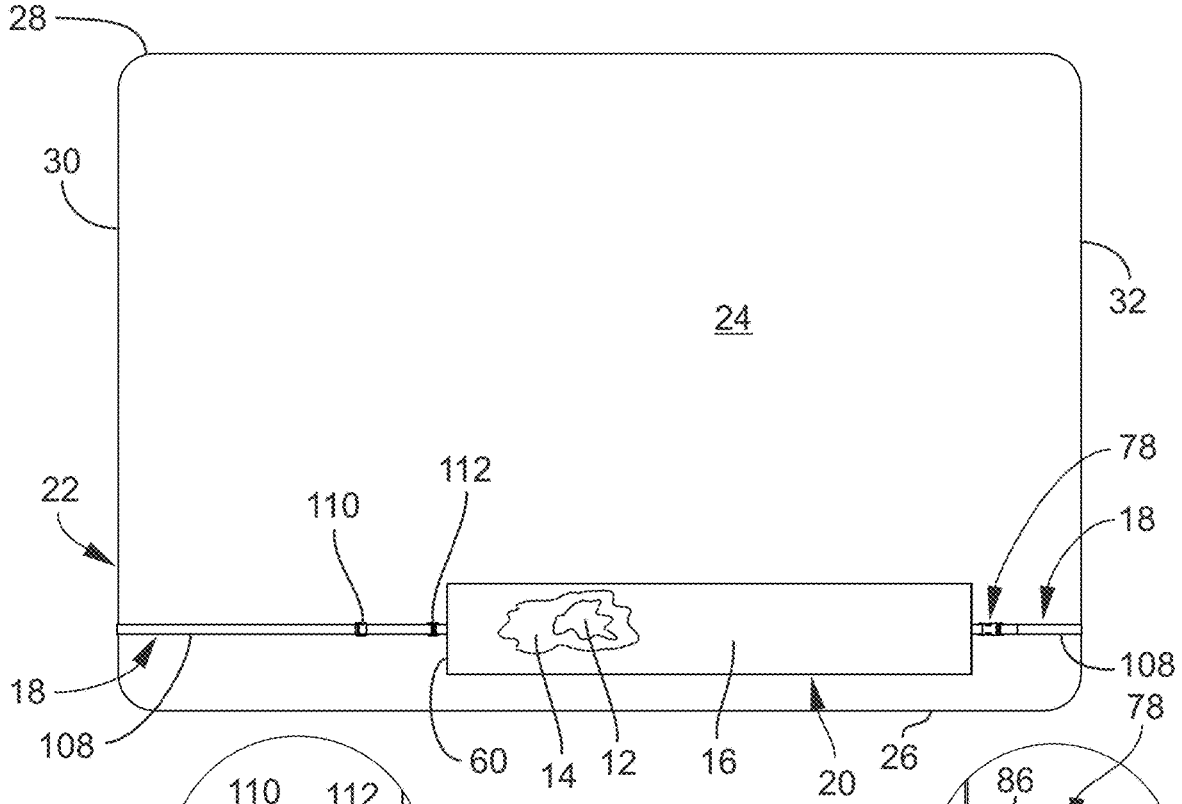
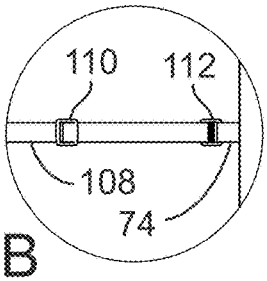
FIG. 2B
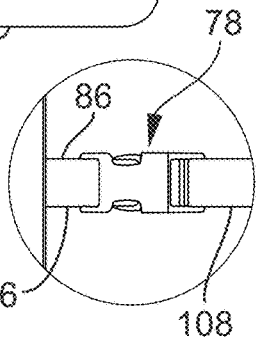
FIG. 2C
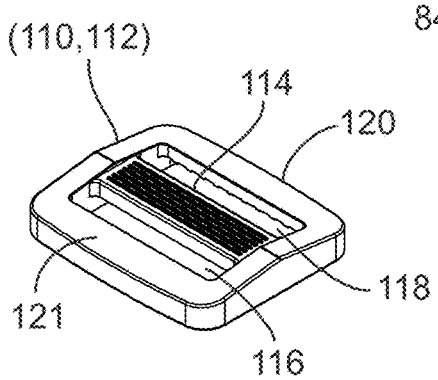
FIG. 2D
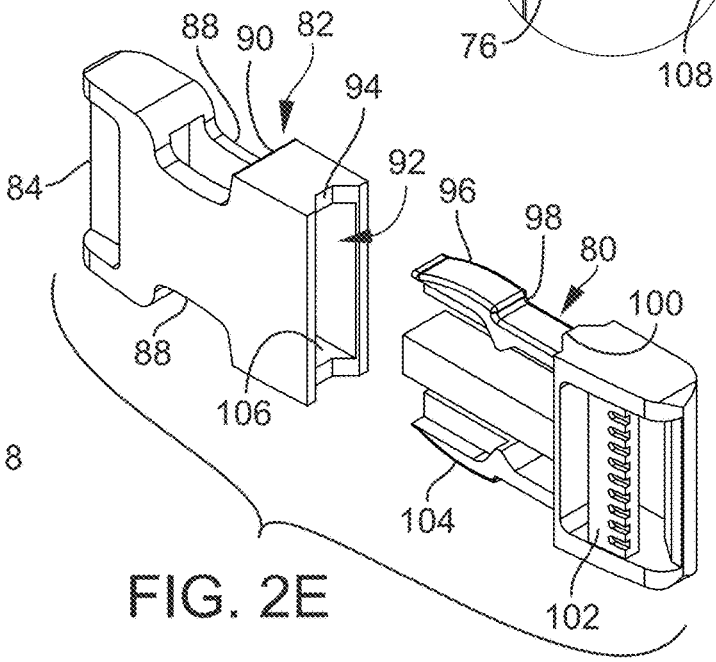
FIG. 2E

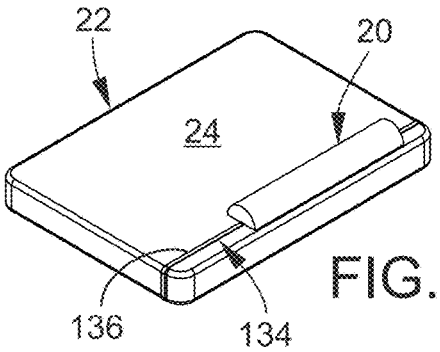
FIG. 4A
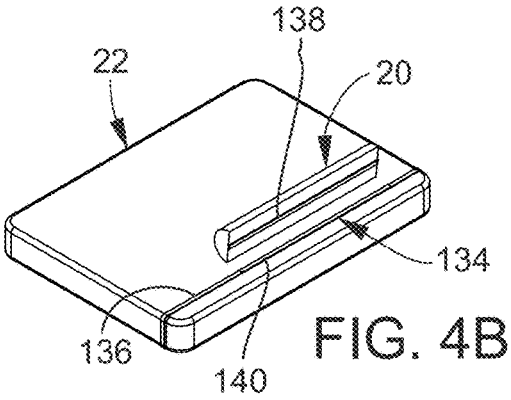
FIG. 4B
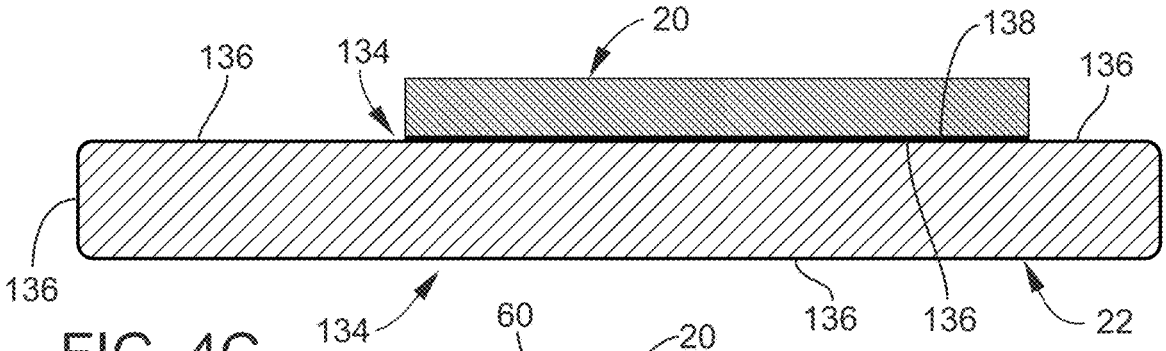
FIG. 4C
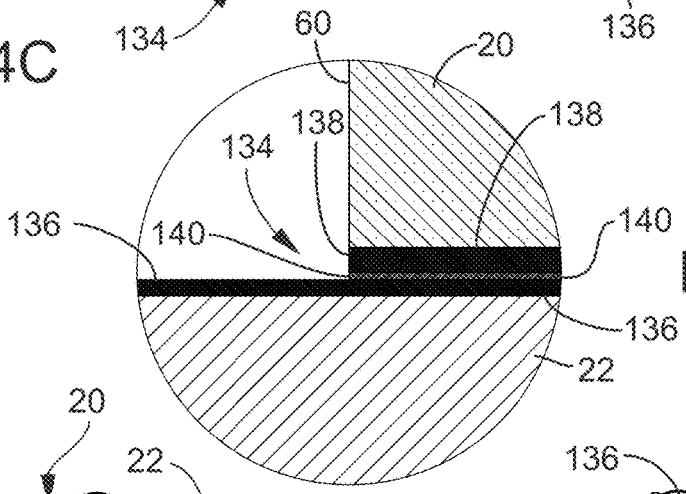
FIG. 4D
FIG. 4E
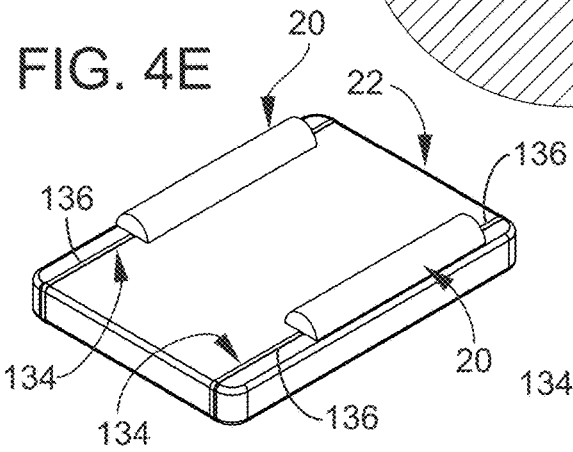
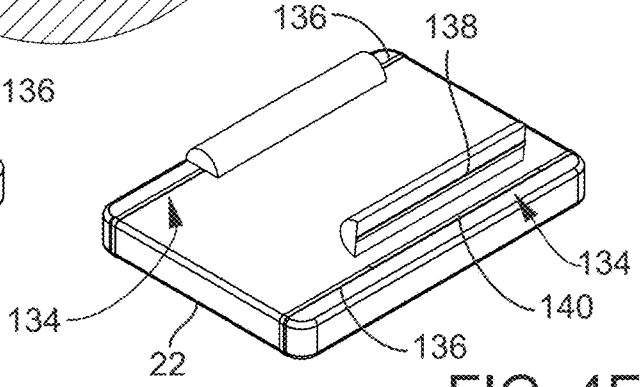
FIG. 4F FIG. 5A
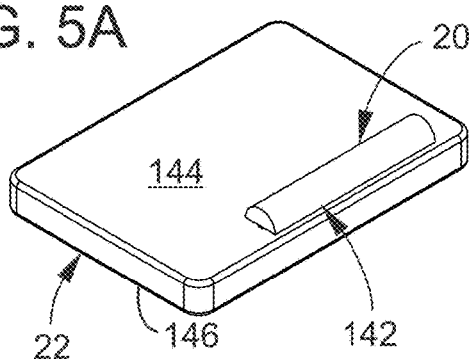
FIG. 5B
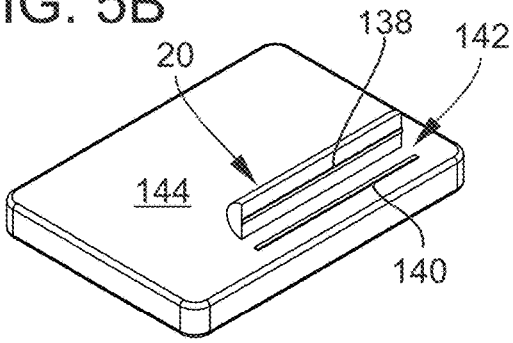
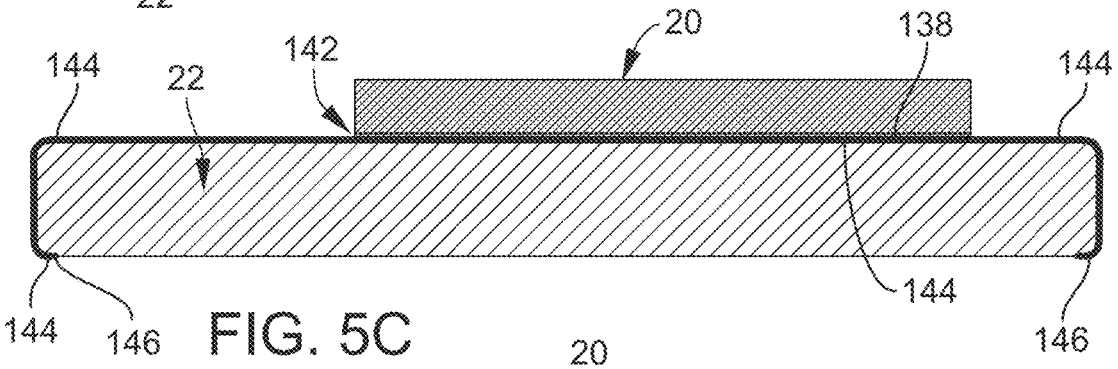
FIG. 5C
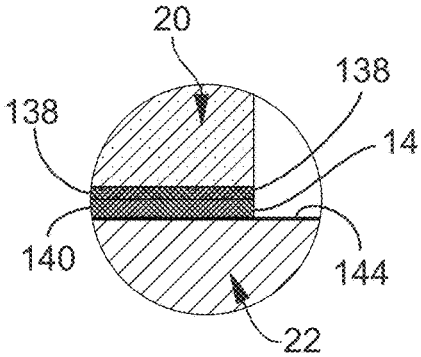
FIG. 5D
FIG. 5E
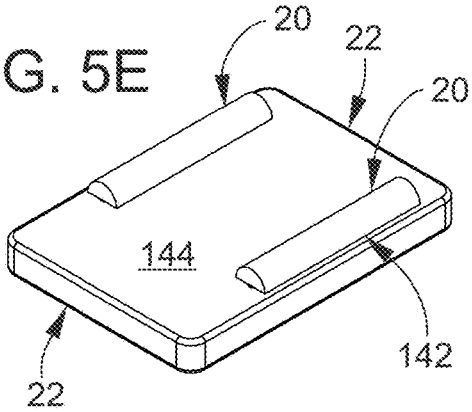
FIG. 5F
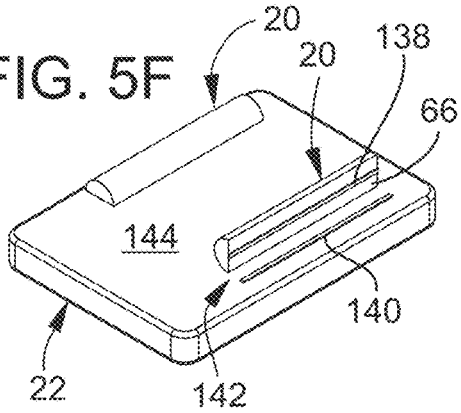

BED BUMPER APPARATUS

This application claims the benefit under 35 U.S.C. 119(e) of U.S. Provisional Patent Application No. 62/841,853 filed May 2, 2019, which is hereby incorporated by reference in its entirety into this application.

FIELD OF THE INVENTION

The present invention relates to apparatus that minimize persons from falling out of bed, and particularly to where such apparatus is a bumper disposed at the side of a mattress.

BACKGROUND OF THE INVENTION

A bed bumper is an apparatus that is disposed at the side of a mattress to minimize the chance that a person sleeping on the mattress rolls off the side of the mattress. The bed bumper is typically placed between a fitted sheet and the top side of a mattress and is permitted to float freely under the fitted sheet and on the top side of the mattress.

SUMMARY OF THE INVENTION

A feature of the present invention is a bed bumper apparatus.

Another feature of the present invention is the provision in a bed bumper apparatus, of an elongate body that is resilient and flexible, where the elongate body includes first and second body ends.

Another feature of the present invention is the provision in a bed bumper apparatus, of an inner cover, where the inner cover is flexible, where the inner cover encloses an entirety of the elongate body such that the elongate body is inaccessible to the touch and such that the elongate body is removable from the inner cover only by destroying an integrity of the inner cover.

Another feature of the present invention is the provision in a bed bumper apparatus, of an outer cover, where the outer cover is flexible, where the outer cover encloses an entirety of the inner cover and elongate body, and where the outer cover includes first and second outer cover ends.

Another feature of the present invention is the provision in a bed bumper apparatus, of a flexible strap having first and second strap ends, where the first strap end is engaged to the first outer cover end, and where the second strap end is engaged to the second outer cover end.

Another feature of the present invention is the provision in a bed bumper apparatus, of the inner cover, having the elongate body therein, being removable from the outer cover.

Another feature of the present invention is the provision in a bed bumper apparatus, of the outer cover including an elongate opening extending between the first and second outer cover ends, where the elongate opening includes a length and is incrementally openable and closeable along the length.

Another feature of the present invention is the provision in a bed bumper apparatus, of the elongate body in section defining a shape of an arch.

Another feature of the present invention is the provision in a bed bumper apparatus, of the elongate body including a bottom surface, where the bottom surface defines a plane and extends to and between the first and second body ends, and where the bottom surface includes first and second side edges that are spaced apart.

Another feature of the present invention is the provision in a bed bumper apparatus, of a top surface, where the top surface defines an arch shape, where the top extends to and between the first and second body ends, and where the top extends to and between the first and second side edges of the bottom.

Another feature of the present invention is the provision in a bed bumper apparatus, of the inner cover being tailored to the elongate body such that movement of the elongate body inside the inner cover is minimized.

Another feature of the present invention is the provision in a bed bumper apparatus, of the outer cover being tailored to the inner cover having the elongate body such that movement of the inner cover, having the elongate body therein, inside of the outer cover is minimized.

Another feature of the present invention is the provision in a bed bumper apparatus, of the strap being separable into two strap portions by a quick release buckle.

Another feature of the present invention is the provision in a bed bumper apparatus, of the strap being adjustable in length such that the strap can be fixed at a first length at one time and fixed at a second length at another time.

Another feature of the present invention is the provision in a bed bumper apparatus, of a flexible elongate strip engagable to the outer cover for engaging the outer cover, having the inner cover and elongate body therein, to a mattress.

Another feature of the present invention is the provision in a bed bumper apparatus, of the flexible elongate strip including a strap, where the strap is separable into two strap portions by a quick release buckle.

Another feature of the present invention is the provision in a bed bumper, of the flexible elongate strip including a strap, where the strap is adjustable in length such that the strap can be fixed at a first length at one time and fixed at a second length at another time.

Another feature of the present invention is the provision in a bed bumper apparatus, of the flexible elongate strip including a strap, where the strap forms at least a portion of a loop, and where the strap is elastic.

Another feature of the present invention is the provision in a bed bumper apparatus, of the flexible elongate strip including a strap, where the strap forms at least a portion of a loop, and where at least a portion of the strap is elastic.

Another feature of the present invention is the provision in a bed bumper apparatus, of the flexible elongate strip including a strap, where the strap defines at least a portion of a loop, where the strap includes first and second ends, and where the strap is nonelastic from the first end to the second end.

Another feature of the present invention is the provision in a bed bumper apparatus, of the flexible elongate strip including a strap and a buckle, where the strap is pullable back through the buckle and connectable to itself such that a length of the strap is adjustable.

Another feature of the present invention is the provision in a bed bumper apparatus, of a flexible loop for engaging a mattress, where the outer cover includes a bottom, where the flexible elongate strip is engaged to the bottom, where the flexible elongate strip is engaged to the flexible loop by a connection, and where the connection is a quick release connection.

Another feature of the present invention is the provision in a bed bumper apparatus, of a fitted sheet for engaging a mattress, the fitted sheet having a quick release strip, wherein the outer cover includes a bottom, wherein the flexible elongate strip is engaged to the bottom, and wherein the flexible elongate strip is engaged to the quick release strip by a connection, the connection being a quick release connection.

Another feature of the present invention is the provision in a bed bumper apparatus, of the elongate body in section including the shape of an arch.

Another feature of the present invention is the provision in a bed bumper apparatus, of the elongate body in section including the shape of a triangle.

Another feature of the present invention is the provision in a bed bumper apparatus, of the elongate body in section including the shape of a trapezoid.

Another feature of the present invention is the provision in a bed bumper apparatus, of the elongate body in section including the shape of a rectangle.

Another feature of the present invention is the provision in a bed bumper apparatus, of the elongate body in section including the shape of a rectangle, where the rectangle includes adjacent sides that are equal in length.

Another feature of the present invention is the provision in a bed bumper apparatus, of an elongate body that is resilient and flexible, where the elongate body includes first and second body ends, of an inner cover, where the inner cover is flexible, where the inner cover encloses an entirety of the elongate body such that the elongate body is inaccessible to the touch and such that the elongate body is removable from the inner cover only by destroying an integrity of the inner cover, of an outer cover, where the outer cover is flexible, where the outer cover encloses an entirety of the inner cover and elongate body, where the outer cover includes first and second outer cover ends, and of a fitted sheet for a mattress, where the fitted sheet includes a receptacle for the outer cover having the inner cover having the elongate body, and where the receptacle is tailored to fit the shape of the outer cover having the inner cover having the elongate body such that movement of the outer cover having the inner cover having the elongate body is minimized in the receptacle.

Another feature of the present invention is the provision in a bed bumper apparatus, of an elongate cylindrical body that is resilient and flexible, where the elongate cylindrical body includes first and second body ends that are open.

Another feature of the present invention is the provision in a bed bumper apparatus, of an inner cylindrical cover, where the inner cylindrical cover is flexible, where the inner cylindrical cover encloses an entirety of the elongate cylindrical body such that the elongate cylindrical body is inaccessible to the touch and such that the elongate cylindrical body is removable from the inner cylindrical cover only by destroying an integrity of the inner cylindrical cover, where the inner cylindrical cover is tailored to the elongate cylindrical body such that movement of the elongate cylindrical body inside the inner cylindrical cover is minimized, where the inner cylindrical cover, having the elongate cylindrical body therein, includes first and second inner cover ends that are open.

Another feature of the present invention is the provision in a bed bumper apparatus, of an outer cylindrical cover, where the outer cylindrical cover is flexible, where the outer cylindrical cover encloses an entirety of the inner cylindrical cover and elongate cylindrical body, where the outer cylindrical cover includes first and second outer cover ends that are open, where the outer cylindrical cover is tailored to the inner cylindrical cover having the elongate cylindrical body such that movement of the inner cylindrical cover, having the elongate cylindrical body therein, inside of the outer cylindrical cover is minimized.

Another feature of the present invention is the provision in a bed bumper apparatus, of a flexible strap forming at least a portion of a loop for engaging a mattress, where the loop extends through the outer cylindrical cover having therein the inner cylindrical cover having therein the elongate cylindrical body.

Another feature of the present invention is the provision in a bed bumper apparatus, of a first flexible strap apparatus engaged to the bed bumper and mattress and having a first strap extending about the mattress that defines a first plane and that minimizes lateral movement of the outer cover.

Another feature of the present invention is the provision in a bed bumper apparatus, of a second flexible strap apparatus engaged to the bed bumper and mattress and having a second strap extending about the mattress that defines a second plane and that minimizes longitudinal movement of the outer cover.

Another feature of the present invention is the provision in a bed bumper apparatus, of the first and second planes being at a right angle to each other such that each of lateral and longitudinal movement of the outer cover, inner cover, and elongate body is minimized.

Another feature of the present invention is the provision in a bed bumper apparatus, of a third strap apparatus engaged to the bed bumper and mattress and having a third strap extending about the mattress that defines a third plane and that minimizes lateral movement of the outer cover, the third plane being parallel to the first plane.

Another feature of the present invention is the provision in a bed bumper apparatus, of each of the first and third strap apparatus engaging an end portion of the outer cover.

An advantage of the present invention is that the present bed bumper apparatus is safe.

Another advantage of the present invention is that the present bed bumper apparatus is securely engagable to a mattress.

Another advantage of the present invention is that the present bed bumper apparatus is quickly engagable to a mattress.

Another advantage of the present invention is that the present bed bumper apparatus is quickly disengagable from a mattress.

Another advantage of the present invention is that the present bed bumper apparatus is easy to engage to a mattress.

Another advantage of the present invention is that the present bed bumper apparatus is easy to disengage from a mattress.

Another advantage of the present invention is that the present bed bumper apparatus is inexpensive to manufacture.

Another advantage of the present invention is that the present bed bumper apparatus is easy to clean.

BRIEF DESCRIPTION OF THE DRAWINGS

FIG. 2A is a top view of the first embodiment of FIG. 1A.

FIG. 2B is a detail view of a portion of FIG. 2A.

FIG. 2C is a detail view of a portion of FIG. 2A.

FIG. 2D is a detail view of a portion of FIG. 2B.

FIG. 2E is a detail exploded view of a portion of FIG. 2C.

FIG. 4A is a perspective view of a third embodiment of the present bed bumper apparatus.

FIG. 4B is a perspective exploded view of the third embodiment of FIG. 4A.

FIG. 4C is a section view of the third embodiment of FIG. 4A.

FIG. 4D is a detail view of a portion of FIG. 4C showing the Velcro® hook and loop connection.

FIG. 4E is a perspective view of the third embodiment of FIG. 4A, with an additional strap and an additional bumper.

FIG. 4F is a perspective exploded view of FIG. 4E.

FIG. 5A is a perspective view of a fourth embodiment of the present bed bumper apparatus.

FIG. 5B is a perspective exploded view of the fourth embodiment of FIG. 5A.

FIG. 5C is a section view of the fourth embodiment of FIG. 5A.

FIG. 5D shows elements 14, 20, 22, 138, 140, and 144.

FIG. 5E is a perspective view of the fourth embodiment of FIG. 5A, with an additional bumper and connection under the bumper.

FIG. 5F is a perspective exploded view of FIG. 5E.

DESCRIPTION

Figure 1A:
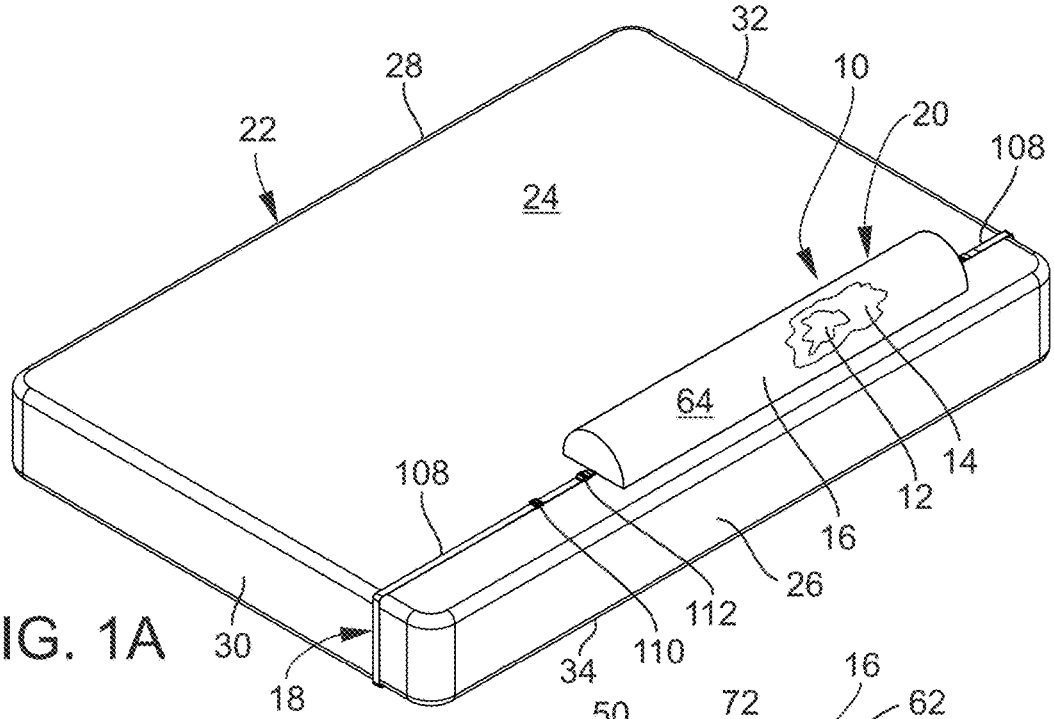
FIG. 1A is a perspective view of a first embodiment of the present bed bumper apparatus.

As shown in FIG. 1, the present bed bumper apparatus is indicated by the reference number 10. Bed bumper apparatus 10 includes an elongate body 12 that is resilient and flexible, an inner cover 14 that is flexible, an outer cover 16 that is flexible, and a strap apparatus 18. The elongate body 12, inner cover 14, and outer cover 16 as a whole may be referred to as a bed bumper 20. The strap apparatus 18 engages the bed bumper 20 and further engages a mattress 22.

The mattress 22 includes a sleeping uppermost surface 24, a first side 26, a second side 28 opposite and parallel to the first side 26, a foot end side 30, and a head end side 32 opposite and parallel to the foot end side 30, and a bottommost surface 34 opposite and parallel to the sleeping uppermost surface 24. Mattress 24 is preferably resilient. Mattress 24 may include coil springs, air, or water. If desired, mattress 24 may have no give and be formed of a solid one-piece material such as plastic, wood, or sand.

The elongate body 12 is resilient and flexible. The elongate body 12 may be formed of foam such as a closed cell polymer foam or an open cell polymer foam. The elongate body 12 is one-piece and integral. The elongate body 12 includes first and second body ends 36, 38, a top 40, and a bottom 42. The bottom 42 or the bottom surface 42 defines a plane and extends to and between the first and second body ends 36, 38. The bottom 42 includes first and second side edges 44, 46 that are spaced apart. The top 40 or top surface 40 defines an arch shape or a half-cylindrical shape. The top 40 extends to and between the first and second body ends 36, 38. The top 40 extends to and between the first and second side edges 44, 46 of the bottom 42 such that the elongate body 12 in section defines a shape of an arch.

Figure 1B:
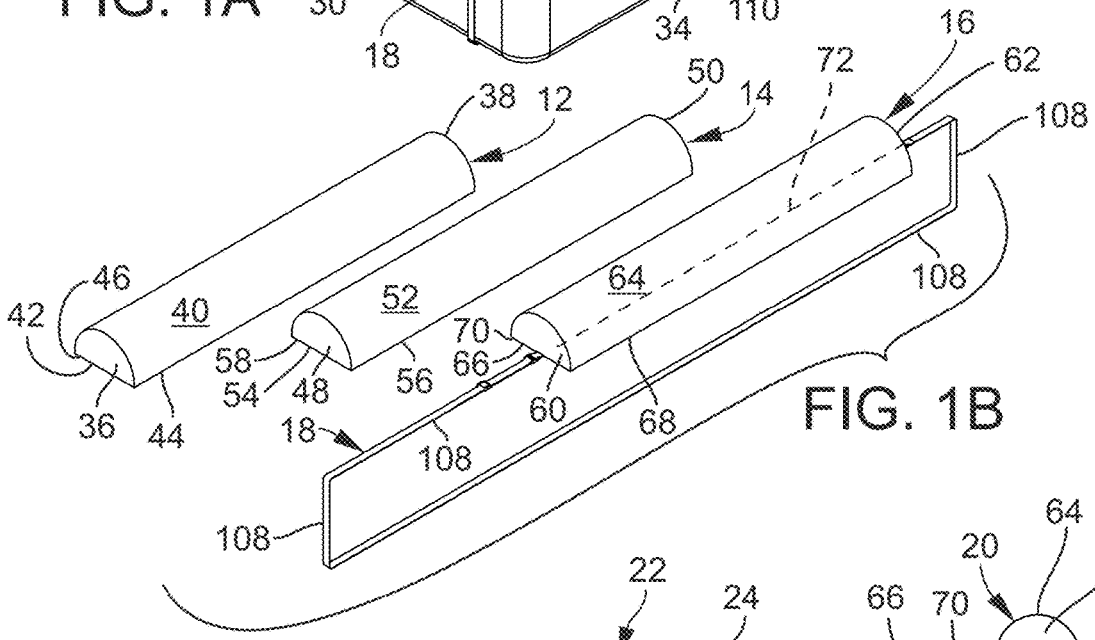
FIG. 1B is an exploded perspective view of the first embodiment of FIG. 1A.
Figure 1C:
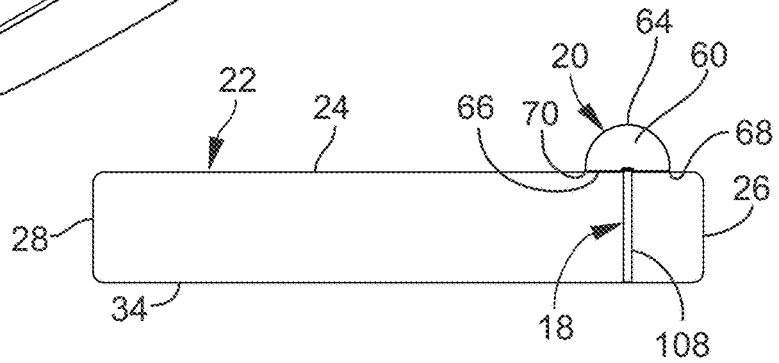
FIG. 1C is an end elevation view of the first embodiment of FIG. 1A.

FIG. 1B shows elongate body 12, inner cover 14, and outer cover 16. Elongate body 12 is solid from bottom 42 to top 40 and solid from first end 36 to second end 38. Elongate body 12 is referred to as being solid even though the elongate body 12 may consist of a polymer open cell foam or a polymer closed cell foam. FIG. 1B shows inner cover 14 without the elongate body 12 therein, but for purposes of illustration shows the form that the inner cover 14 takes when elongate body 12 is disposed in the inner cover 14. FIG. 1B shows outer cover 16 without the inner cover 14 therein and without the elongate body 12 therein, but for purposes of illustration shows the form that the outer cover 16 takes when the inner cover 14 and elongate body 12 are disposed therein.

The inner cover 14 is one-piece and integral. The inner cover 14 includes first and second ends 48, 50, a top 52, and a bottom 54. The bottom 54 or the bottom surface 54 defines a plane and extends to and between the first and second ends 48, 50. The bottom 54 includes first and second side edges 56, 58 that are spaced apart. The top 52 or top surface 52 defines an arch shape or a half-cylindrical shape. The top 52 extends to and between the first and second ends 48, 50. The top 52 extends to and between the first and second side edges 56, 58 of the bottom 54 such that the inner cover 14 in section defines a shape of an arch or half-cylinder. The inner cover 14 is flexible and may be formed of textile or fabric. The inner cover 14 encloses an entirety of the elongate body 12 such that the elongate body 12 is inaccessible to the touch and such that the elongate body 12 is removable from the inner cover 14 only by destroying an integrity of the inner cover 14. The inner cover 14 is tailored to the elongate body 12 such that movement of the elongate body 12 inside the inner cover 14 is minimized.

The outer cover 16 is one-piece and integral. The outer cover 16 includes first and second ends 60, 62, a top 64, and a bottom 66. The bottom 66 or the bottom surface 66 defines a plane and extends to and between the first and second ends 60, 62. The bottom 66 includes first and second side edges 68, 70 that are spaced apart. The top 64 or top surface 64 defines an arch shape or a half-cylindrical shape. The top 64 extends to and between the first and second ends 60, 62. The top 64 extends to and between the first and second side edges 68, 70 of the bottom 66 such that the outer cover 16 in section defines a shape of an arch or half-cylinder.

The outer cover 16 is flexible and may be formed of textile or fabric. The outer cover 16 encloses an entirety of the inner cover 14 and elongate body 12. The outer cover 16 is tailored to the inner cover 14 having the elongate body 12 such that movement of the inner cover 14, having the elongate body 12 therein, inside of the outer cover 16 is minimized. The outer cover 16 includes an elongate opening extending to and between the first and second outer cover ends 60, 62. The elongate opening includes a length defined as the distance between the ends 60, 62. The elongate opening is incrementally openable and closeable along the length by a zipper 72 such that the inner cover 14 having the elongate body 12 is removable from the outer cover 16 by opening the zipper 72 and removing the inner cover 14 having the elongate body 12.

Flexible strap apparatus 18 includes first and second strap ends or strap loops 74, 76. The first strap end 74 is engaged to the junction of the first outer cover end 60 and bottom 66. The second strap end 76 is engaged to the junction of the second outer cover end 62 and the bottom 66. The strap apparatus 18 is separable into two strap portions by a quick release buckle 78 having a male portion 80 and a female portion 82. Female portion 82 includes a post 84 for engaging strap end 76 or strap loop 76. Strap loop 76 is a strap section 86 that includes an end that is engaged to the junction of cover end 62 and bottom 66, which strap section 86 then extends from such junction, about post 84, and then returns to such junction where a second end of the strap section 86 is engaged to such junction. Female portion 82 includes a pair of opposing indents 88, a pair of opposing prong catching edges 90, a female opening 92, and a stop 94. Male portion 80 includes a pair of opposing prongs 96, with each of the prongs 96 having a catch 98 that catches prong catch edge 90 of the female portion 82. Male portion 80 further includes a pair of opposing stops 100 and a post 102. To release catches 98 from catch edges 90, fingers are depressed toward indents 88 to pinch the prongs 96 together. To engage the catches 98 with the catch edges 90, the prongs 96 are inserted into female opening 92 such that the prongs 96 are drawn together by rounded surfaces 104 sliding on opposing internal surfaces 106 of female portion 82. Prongs 96 spring apart when prongs 96 pass beyond internal surfaces 106 and are fully inserted into female portion 82. When prongs 96 spring apart, catches 98 engage catch edges 90 to lock the strap apparatus 18. Strap apparatus 18 further includes a strap portion 108 that includes an end that is looped about post 108 of male portion 80. From male portion 80, strap portion 108 extends over the mattress sleeping surface 24, down the mattress head end side 32, across the mattress bottom 34, up the mattress foot end side 30, back across the mattress sleeping surface 24, through a first buckle 110, through a second buckle 112, and back to the first buckle 110 where an end of the strap portion 108 is looped around a post 114 of buckle 110. On its journey from male portion 80, strap portion 108 extends upwardly through slot 116, over post 114, and downwardly through slot 118 and then proceeds to buckle 112. On its journey from buckle 110 to buckle 112, strap portion 108 extends upwardly through slot 116 of buckle 112, around post 114 of buckle 112, and back to buckle 110 where the end of strap portion 108 is looped about post 114 of buckle 110. Each of the buckles 110, 112, includes a side post 120. Strap loop 74 that is engaged by stitching to outer cover 16 at the junction of bottom 66 and end 60 is engaged to buckle 112 by being looped around side post 120 of buckle 112. Strap loop or strap end 74 is engaged to outer cover 16 with a strap section 86 in the manner that strap loop 76 is engaged to outer cover 16 with strap section 86. Buckles 110, 112 in combination can be referred to as a length adjustor. Utilizing the buckles 110, 112, the strap apparatus 18 is adjustable in length such that the strap apparatus 18 can be fixed at a first length at one time and fixed at a second length at another time. Feeding strap portion 108 up through buckle 110 and down through buckle 112 is a friction fit that can be tightened and loosened. When loosened, buckle 110 can be drawn relatively to and away from buckle 112. When the buckle 110 is drawn away from buckle 112, the length of the upper and lower sections of strap between buckles 110, 112 increases, thereby decreasing the effective length of strap apparatus 18 and thereby tightening the strap apparatus 18 about the mattress 22.

The first embodiment of FIGS. 1A, 1B, 1C, 2A, 2B, 2C, 2D, and 2E may be described as follows: the present bed bumper 20 is comprised of a body 12 which is elongated in form and of sufficient density that it retains its form when subjected to pressure as from a person rolling up against it or on it. Such elongated body 12 is completely enclosed within a form-fitting, flexible, inner cover 14 which has no mechanism for removal. Such elongated body 12 within its inner cover 14 is completely enclosed within a second, outer, removable cover 16. This second cover 16 is comprised of a flexible material in the form of the elongated body 12. Such second, outer, removable cover 16 includes an opening running the full length of the outer cover 16 and is located on the underside 66 of the outer cover 16, and has affixed to it a quick connect device or devices, such as a zipper, which can be opened to access and remove the elongated body 12 in its inner cover 14 and closed to secure the elongated body 12 and inner cover 14 within. The second, outer, removable cover 16 includes two ends, each of which is attached to an end of a strap 108. Such strap 108 is comprised of a flexible material and includes two ends, each of which may be attached to an end of the second, outer, removable cover 16 in a secure fashion such that removal of the strap 108 from the flexible second cover 16 will destroy the strap or the outer cover 16, and the connection between them. This strap 108, whether or not including such secure fashion feature, includes at a point along its length near the first end of the elongated body 12, a two-piece buckle 78 which may be opened and closed so that when the buckle 78 is closed the strap 108 forms a continuous loop, with the outer cover 16 being part of the loop. When the buckle 78 is opened the loop is broken. This buckle 78 includes a release mechanism so that the buckle 78 will open. This release mechanism also serves as a lock mechanism that secures the buckle 78 in a closed function and ensures the strap loop formed will remain until the release mechanism is activated. This strap 108 includes, at a point along its length near the second end of the elongated body 12, two retention buckles 110, 112, each with two open slots 116, 118 through which the flexible strap 108 is woven in an over-under fashion.

Figure 3A:
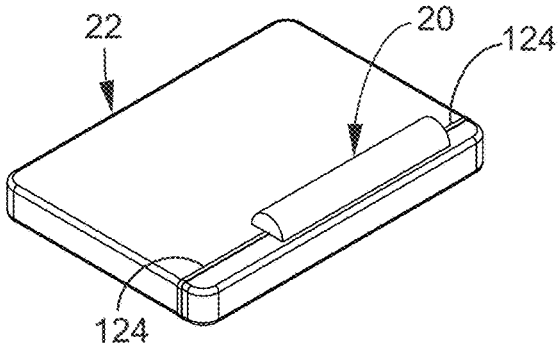
FIG. 3A is a perspective view of a second embodiment of the present bed bumper apparatus.
Figure 3B:
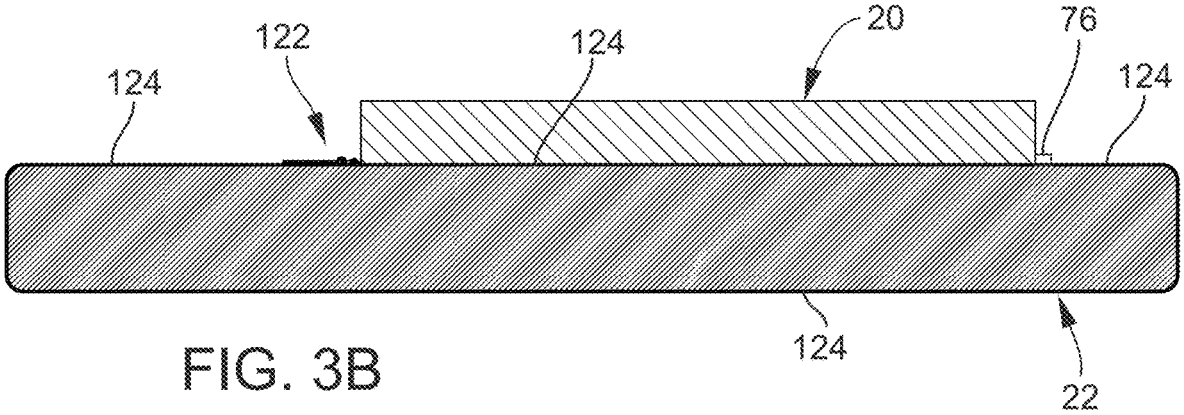
FIG. 3B is a section view of the second embodiment of FIG. 3A.
Figure 3C:
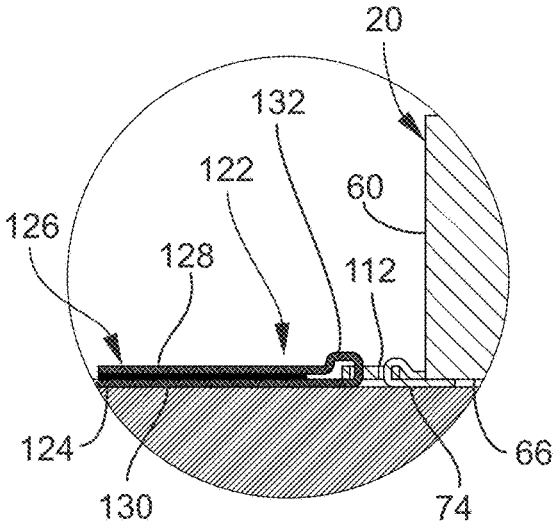
FIG. 3C is a detail view of a portion of FIG. 3C showing a Velcro® hook and loop connection.
Figure 3D:
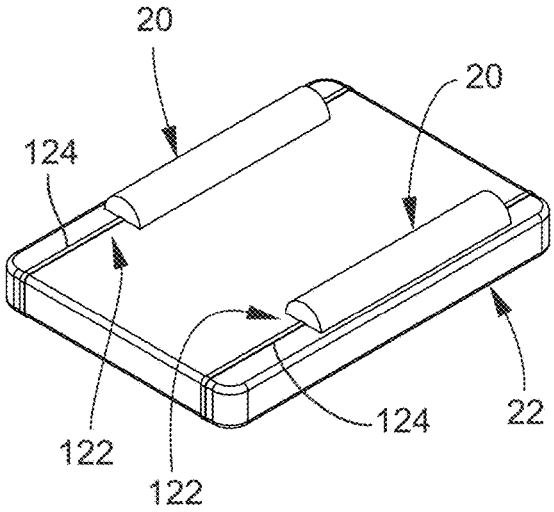
FIG. 3D is a perspective view of the second embodiment of FIG. 3A, with an additional strap and with an additional bumper.

As indicated above, FIG. 3A is a perspective view of a second embodiment of the present bed bumper apparatus, FIG. 3B is a section view of the second embodiment of FIG. 3A, FIG. 3C is a detail view of a portion of FIG. 3C showing a Velcro® hook and loop connection, and FIG. 3D is a perspective view of the second embodiment of FIG. 3A, with an additional strap and with an additional bumper. Each of FIGS. 3A, 3B, 3C, and 3D shows bed bumper 20, i.e., outer cover 16 having inner cover 14 having elongate body 12. This second embodiment includes a strap apparatus 122 that includes the strap loop 74 on one end of the outer cover 16, the strap loop 76 on the other end of the outer cover 16, a buckle 112 engaged to strap loop 74, a buckle 112 engaged to strap loop 76, and a strap 124 engaged to buckle 112 that is engaged to strap loop 74. Strap 124 includes a strap end portion 126 that has one strip 128 of Velcro® loop connectors and one strip 130 of Velcro® hook connectors. Strip 128 is spaced apart from strip 130 by a strap portion 132. Strap portion 132 is engaged by side post 121 of buckle 112. Loop strip 128 engages hook strip 130 to engage strap 124 about the mattress 22 and to provide for length adjustment as well by axially adjusting strips 128, 130 relative to each other. In a first case, the distal end of the strap 124 may have a loop end that is engaged to buckle 112 engaged to strap loop 76 on the other end of the bumper 20. In a second case, strap 124 may extend under the bumper 20 and be stitched to the bottom 66 of outer cover 16, where such stitching occurs from one end 62 to the other end 60, and in which case the distal end of strap 124 may be stitched to strap end 74, and in which case the elongate opening and zipper 72 may be slightly offset. A third case or third alternative is to provide a second strap portion 126 having loop and hook strips 128, 130 at the distal end of strap 124 and utilizing strap portion 76 to hold buckle 112 such that there are two locations for length adjustment of strap 124, where one location is adjacent cover end 60 and where the other location is adjacent to cover end 62. In the first and third cases above, the bumper 20 is pulled or tensioned from each of the ends. In the second case above, the bumper 20 is tensioned from one end and further tensioned along the bottom 60 of the outer cover 16. FIG. 3D shows that two bed bumpers 20 may be used on a single mattress 22.

As indicated above, FIG. 4A is a perspective view of a third embodiment of the present bed bumper apparatus. FIG. 4B is a perspective exploded view of the third embodiment of FIG. 4A. FIG. 4C is a section view of the third embodiment of FIG. 4A. FIG. 4D is a detail view of a portion of FIG. 4C showing the Velcro® hook and loop connection. FIG. 4E is a perspective view of the third embodiment of FIG. 4A, with an additional strap and an additional bumper. FIG. 4F is a perspective exploded view of FIG. 4E. In this embodiment, a strap apparatus 134 includes an endless strap 136, a Velcro® hook strip portion 138, and a Velcro® loop strip portion 140. Endless strap 136 may be an elastic strap. Endless strap 136 may have an elastic portion, with a remainder of the strap being inelastic or nonstretchable. Endless strap 136 may be an inelastic or nonstretchable strap that is preconfigured or has a set or given length for a given size of mattress. Loop strip 140 is engaged to endless strap 136. Loop strip 140 has a length about equal to or less than the length of bumper 20, i.e., the distance between ends 60 and 62. Hook strip 138 is engaged centrally to bottom 66 of outer cover 16, in which case the zipper 72 and its elongate opening is offset from a central longitudinal portion. Alternatively, zipper 72 and its elongate opening may remain along the central longitudinal portion as shown in FIG. 1B and the hook strip 138 may be offset from the central longitudinal portion. Hook strip 138 has a length equal to or less than the length of bottom 66 of outer cover 16. When strips or strip portions 140, 138 are engaged to each other, then strap 136 is engaged to bumper 20, thereby holding bumper 20 in place on the sleeping surface 24 of mattress 22 because strap 136 is engaged about the mattress 22. FIGS. 4A and 4B shows that a single bumper 20 may be employed, with the bumper 20 secured by a strap apparatus 134. FIGS. 4E and 4F show that two bumpers 20 may be employed on one mattress 22, with each of the bumpers 20 secured with its own strap apparatus 134.

As indicated above, FIG. 5A is a perspective view of a fourth embodiment of the present bed bumper apparatus. FIG. 5B is a perspective exploded view of the fourth embodiment of FIG. 5A. FIG. 5C is a section view of the fourth embodiment of FIG. 5A. FIG. 5E is a perspective view of the fourth embodiment of FIG. 5A, with an additional bumper 20 and connection 142 under the bumper 20. FIG. 5F is a perspective exploded view of FIG. 5E. Connection 142 or strap apparatus 142 includes Velcro® hook strip 138 or strip portion 138 and Velcro® loop strip 140 or strip portion 140. Instead of being engaged to strap 136, loop strip 140 is engaged to a fitted sheet 144. Fitted sheet 144 may be waterproof. Fitted sheet 144 has a top sleeping section and four side sections, with two of the four side sections being a head section and a foot section. The fitted sheet 144 includes a lower periphery 146 running along the lower edges of the four side sections. This lower periphery includes one or more elastic portions such that fitted sheet 144 remains in place about the mattress 22 to a greater degree than a nonfitted sheet to thereby keep loop strip 140 at one location or to keep a pair of loop strips 140 at their respective locations for two bumpers 20, as shown in FIGS. 5E and 5F.

Figure 6A:
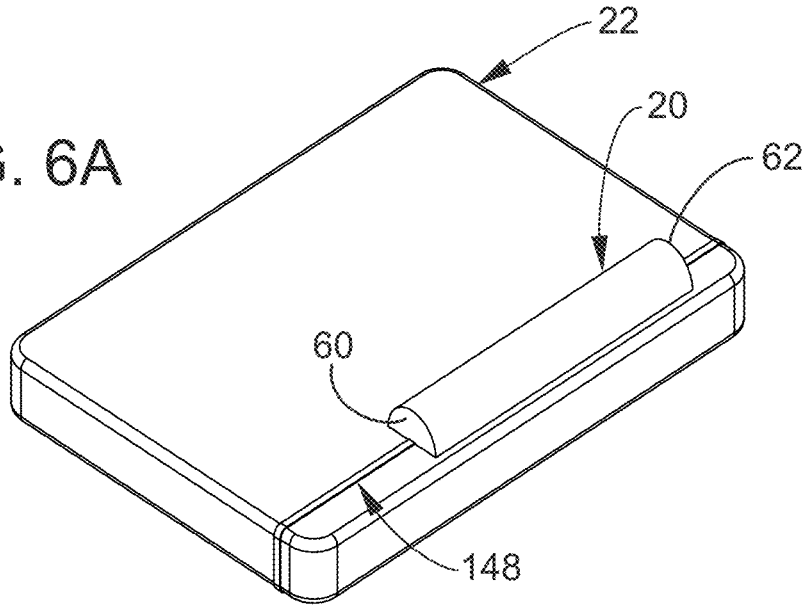
FIG. 6A is a perspective view of a fifth embodiment of the present bed bumper apparatus having an elastic strap or a strap with an elastic portion.
Figure 6B:
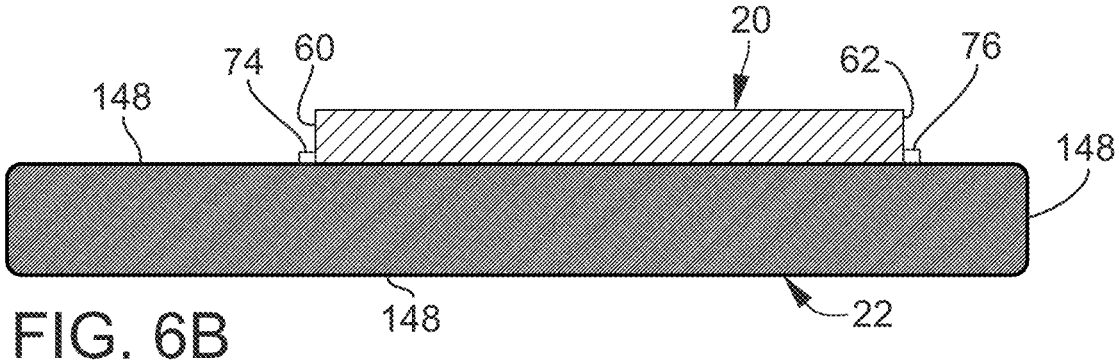
FIG. 6B is a section view of the fifth embodiment of FIG. 6A.

As indicated above, FIG. 6A is a perspective view of a fifth embodiment of the present bed bumper apparatus having an elastic strap 148 or a strap 148 with an elastic portion. FIG. 6B is a section view of the fifth embodiment of FIG. 6A. Strap 148 may be engaged in a number of ways to bumper 20. In a first case, strap 148 may be engaged to the bottom 66 of outer cover 16 along a central longitudinal portion, in which case the zipper 72 and its elongate opening may be offset from the central longitudinal portion. In this first case, strap 148 is endless and may either be elastic or have one or more elastic portions. In a second case, strap 148 has two ends, with one end looped about side post 121 of buckle 112 engaged to strap loop 74 on cover end 60 and with the other end looped about side post 121 of buckle 112 engaged to strap loop 76 on cover end 62 and, in this second case strap 148 may be elastic or have one or more elastic portions.

Figure 6C:
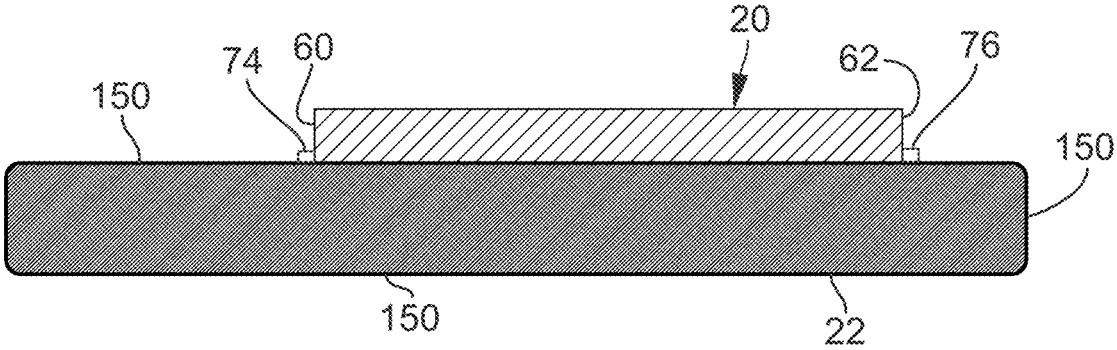
FIG. 6C is a section view of a sixth embodiment of the present bed bumper apparatus, where the sixth embodiment includes a preconfigured nonstretchable strap that includes no elastic and no connections, which preconfigured nonstretchable strap has a given or fixed size for a given or set mattress size.

As indicated above, FIG. 6C is a section view of a sixth embodiment of the present bed bumper apparatus, where the sixth embodiment includes a preconfigured inelastic or nonstretchable strap 150 that includes no elastic and no connections such as connection 78, which preconfigured nonstretchable strap 150 has a given or fixed size for a given or set mattress size. In a first case, strap 150 may be engaged to the bottom 66 of outer cover 16 along a central longitudinal portion, in which case the zipper 72 and its elongate opening may be offset from the central longitudinal portion. In this first case, strap 150 is endless and is inelastic or nonstretchable. In a second case, strap 150 has two ends, with one end looped about side post 121 of buckle 112 engaged to strap loop 74 on cover end 60 and with the other end looped about side post 121 of buckle 112 engaged to strap loop 76 on cover end 62 and, in this second case strap 150 is inelastic or nonstretchable. To engage the inelastic or nonstretchable strap 150, the mattress 22 may be first squeezed to as to insert the mattress 22 relatively into the loop of the strap 150 and then, second, released such that the mattress 22 returns to its original shape to press outwardly against the loop of the strap 150.

FIGS. 7A, 8B, 9A, and 9B show embodiments where the present bed bumper apparatus may be engaged to a mattress by three or more straps, where the three straps may be any of the straps disclosed herein, including strap apparatus 18 (having strap 180), strap apparatus 122 (having strap 124), 134 (having strap 136), strap apparatus 142 (having no wrap around strap), strap apparatus 148, and strap apparatus 150. If strap apparatus 142 is employed where no straps run about the mattress 22 and where fitted sheet 144 is used, hook strips 138 may be engaged both laterally and longitudinally on bottom 66 of outer cover 16 and loop strips 140 may be engaged both laterally and longitudinally on the fitted sheet 144. As shown, straps 108, 124, 136, 148, 150 may extend both longitudinally and laterally and both of the longitudinal and lateral straps engage the bumper 20 either on the bottom 66 of the outer cover 16 or by strap loops 74, 76, which strap loops 74, 76 may be engaged to the cover ends 60, 62 as well as the outer cover edges 68, 70. In such lateral and longitudinal strap arrangements of FIGS. 7A, 8B, 9A, and 9B, the lateral and longitudinal straps may be independent of all of the other lateral or longitudinal straps or the lateral and longitudinal straps may engage each other where such lateral and longitudinal straps cross. In FIGS. 7A, 8B, 9A, and 9B, the lateral and longitudinal straps extend about the sides, top, and bottom of the mattress 22.

Figure 8A:
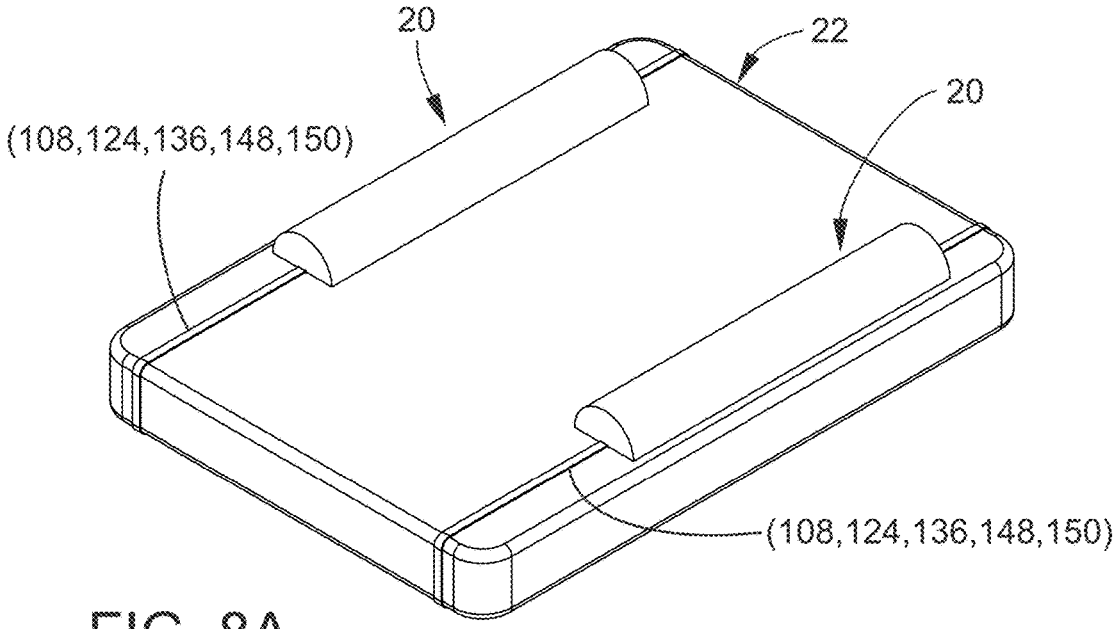
FIG. 8A is a perspective view of the present bed bumper apparatus where opposing bed bumpers are each engaged to a mattress by a single strap, where such single strap may be any of the straps disclosed herein.

In FIG. 8A, any of the strap apparatus of the present invention may be employed, including strap apparatus 18 (having strap 180), strap apparatus 122 (having strap 124), 134 (having strap 136), strap apparatus 142 (having no wrap around strap), strap apparatus 148, and strap apparatus 150. FIG. 8A shows two parallel bumpers 20. In FIG. 8A, the longitudinal straps extend about the sides, top, and bottom of the mattress 22.

Figure 8B:
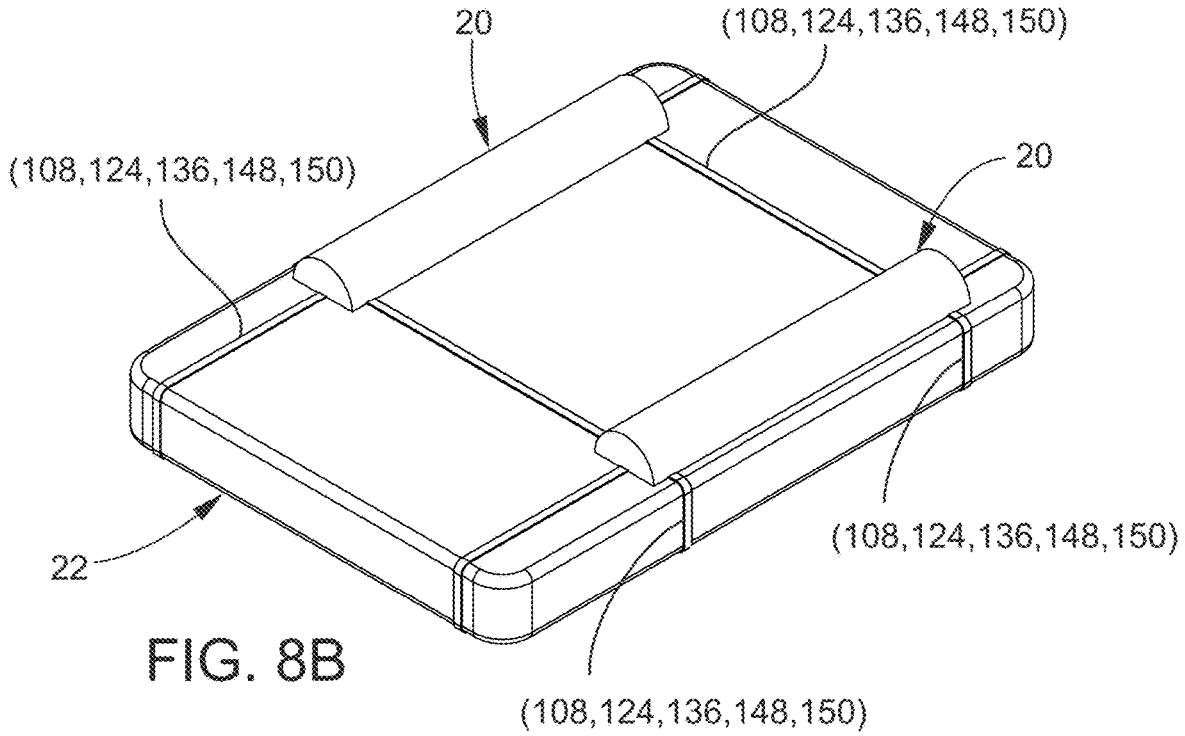
FIG. 8B is a perspective view of the present bed bumper apparatus where opposing bed bumpers are each engaged to a mattress by three straps, where any of such three straps may be any of the straps disclosed herein, and where the opposing bed bumpers share two of the straps.

In FIG. 8B, two parallel bumpers 20 are employed, where each of the bumpers 20 is secured by a lateral strap and a longitudinal strap.

Figure 9A:
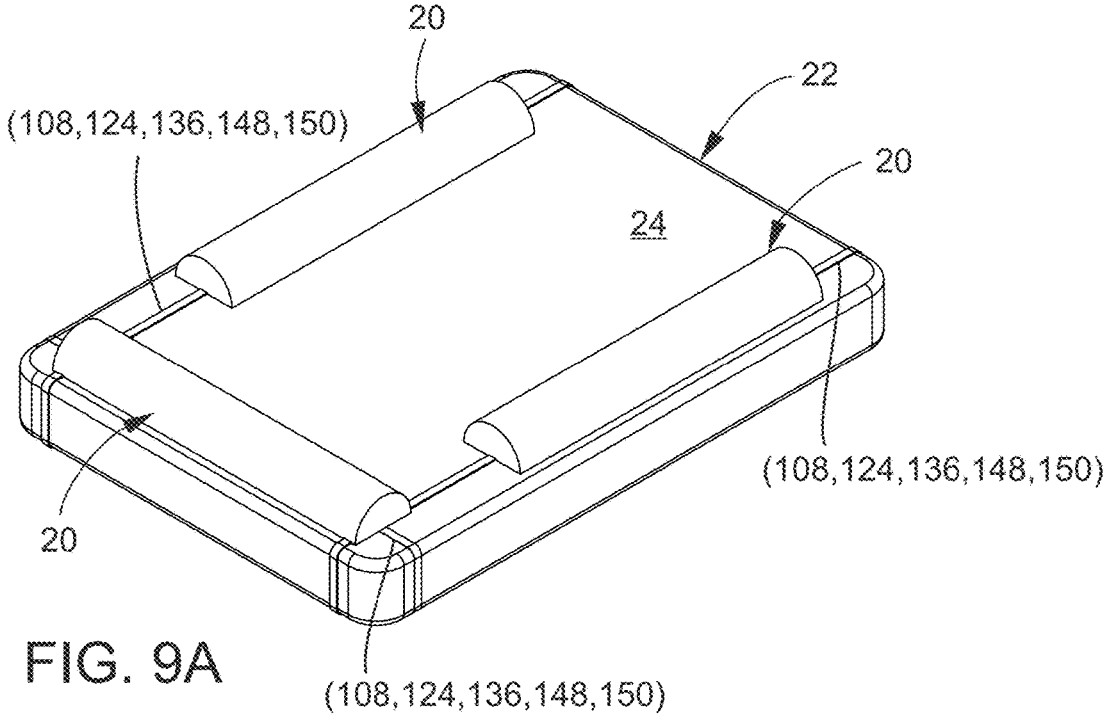
FIG. 9A is a perspective view of the present bed bumper apparatus where bumpers confront three sides of the mattress, where any straps of the present invention engage the bumpers to the mattress, where two opposing bumpers are each engaged to the mattress by a single strap, where an end bumper is engaged to the mattress by three straps, and where the three bumpers share straps.

In FIG. 9A, two parallel bumpers 20 are employed and a third bumper 20 is further employed, where the third bumper runs at a right angle to each of the two parallel bumpers 20, and where each of the bumpers 20 is secured by a lateral strap and a longitudinal strap.

Figure 9B:
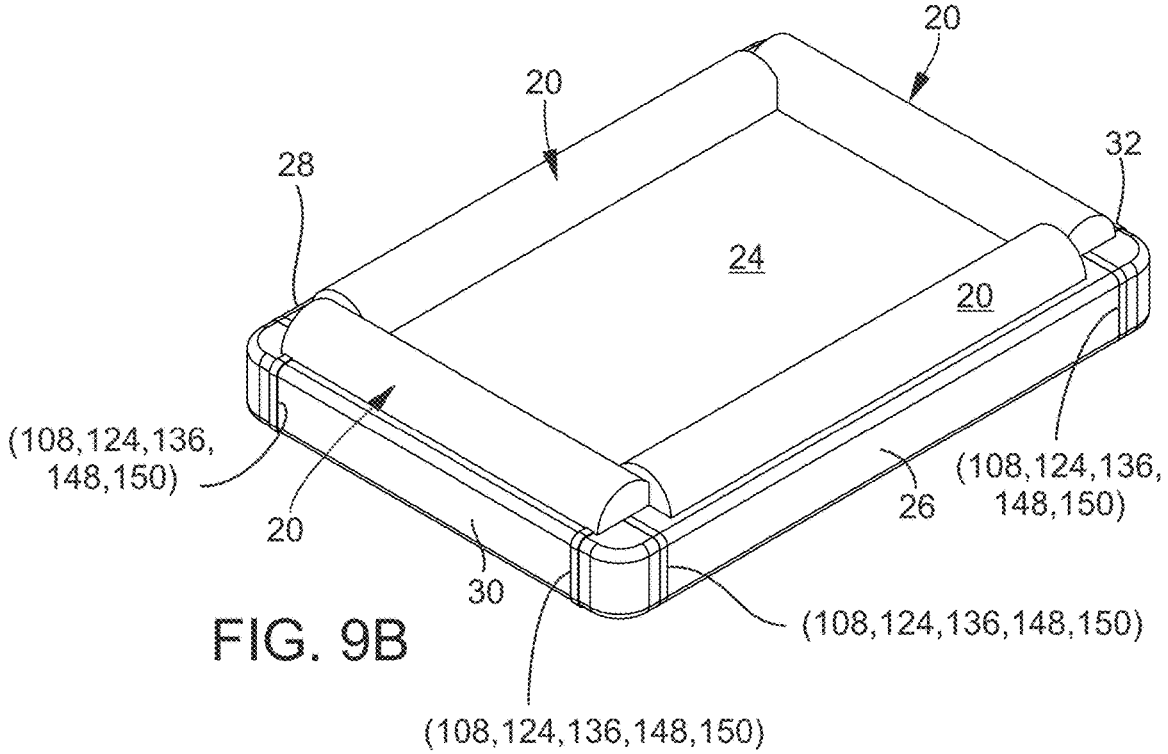
FIG. 9B is a perspective view of the present bed bumper apparatus of FIG. 9A where such FIG. 9A arrangement includes an additional bumper, where such additional bumper is engaged to the mattress by three straps, where such straps may be any of the straps of the present invention.

In FIG. 9B, a first set of two parallel bumpers 20 are employed and second set of two parallel bumpers 20 are further employed, where each of the bumpers 20 of the first set runs at a right angle to each of the bumpers 20 of the second set. The bumpers 20 adjacent to the sides 26, 28 extend to and engage the bumpers 20 on the foot and head ends 30, 32, where ends of the side bumpers engage the sides of the bumpers at the foot and head ends, 30, 32. It is preferred that each of the bumpers 20 abut two other bumpers 20 such that gaps are eliminated between the bumpers 20. Each of the bumpers 20 is secured by a lateral strap and a longitudinal strap. The four bumpers 20 define a rectangular enclosed space with unequal adjacent sides.

Figure 10A:
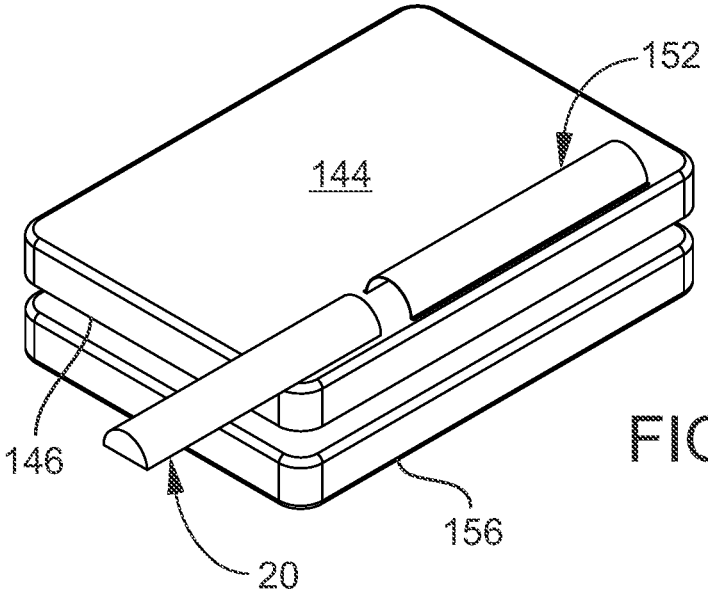
FIG. 10A is a perspective view of a seventh embodiment of the present bed bumper apparatus, where a fitted sheet includes a receptacle for the bumper.
Figure 10B:
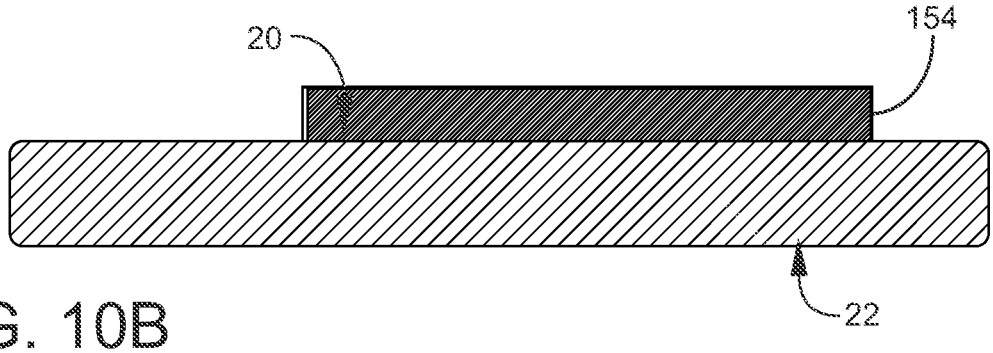
FIG. 10B is a section view of the seventh embodiment of FIG. 10A.
Figure 10C:
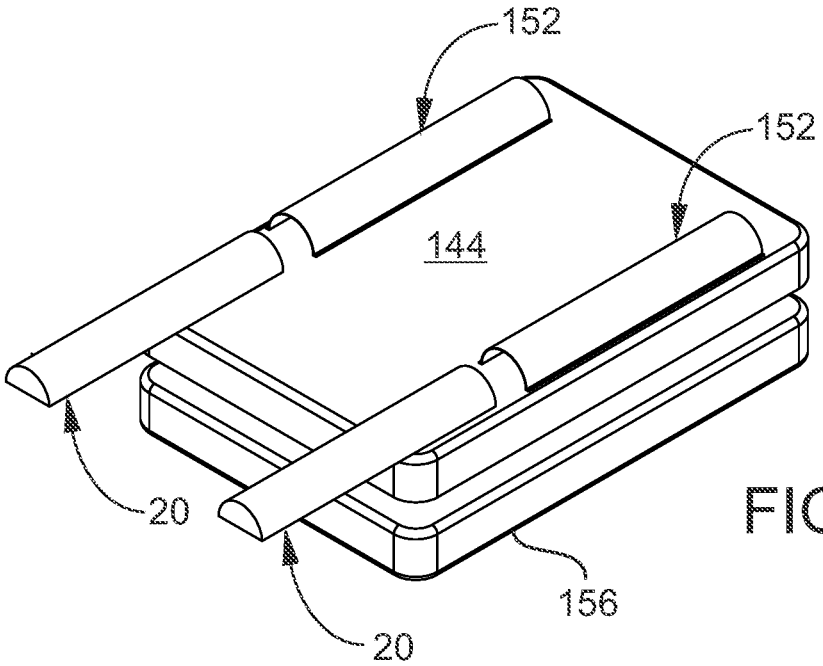
FIG. 10C is a perspective view of the seventh embodiment of FIG. 10A showing two receptacles or two pockets for two bumpers, with each of the pockets being adjacent to a side of the mattress.

As indicated above, FIG. 10A is a perspective view of a seventh embodiment of the present bed bumper apparatus, where a fitted sheet 144 includes a receptacle or pocket 152 for the bumper 20, FIG. 10B is a section view of the seventh embodiment of FIG. 10A, and FIG. 10C is a perspective view of the seventh embodiment of FIG. 10A showing two pockets or two receptacles for two bumpers, with each of the pockets being adjacent to a side of the mattress. Instead of including loop strip portion 140, fitted sheet 144 includes receptacle 152. Each of fitted sheet 144 and receptacle 152 may be waterproof. As indicated above, fitted sheet 144 has a top sleeping section and four side sections, with two of the four side sections being a head section and a foot section. The fitted sheet 144 includes the lower periphery 146 running along the lower edges of the four side sections. This lower periphery includes one or more elastic portions such that fitted sheet 144 remains in place about the mattress 22 to a greater degree than a nonfitted sheet to thereby keep receptacle 152 at one location or to keep one, two, three, or four receptacles 152 at their respective locations, like in one or more of FIG. 7A, 8A, 8B, 9A, or 9B for one, two, three, or four bumpers 20. Receptacle 152 is one-piece and integral with fitted sheet 144. Receptacle 152 is the same shape as top 52 of inner cover 14. Receptacle 152 is the same shape as top 64 of outer cover 16. Receptacle 152 is an arch or half cylindrical shape. Receptacle 152 may have two open ends if desired such that receptacle 152 includes a through opening. Receptacle 152 may have one open end and one closed end 154, as shown in FIG. 10B. If desired, the other end of receptacle 152 may also be closed, such as in the nature of a flap where one edge portion of the flap is integral with fitted sheet 144 and the remaining edge portion of the flap is closeable by a zipper or other quick release connection. Receptacle 152 is shown adjacent to one side of the fitted sheet 144, but may be disposed adjacent to both sides of the fitted sheet 144 as shown in FIG. 10C, and one or more further receptacles 152 may be disposed adjacent to the foot or head ends of the fitted sheet 144. Receptacle 152 and the portion of the fitted sheet 144 below receptacle 152 are tailored to fit the bumper 20 such that movement of the bumper 20 when engaged in the receptacle 152 is minimized. FIG. 10A shows a mattress support 156 or a box spring 156 disposed below mattress 22 having fitted sheet 144. If desired, the outer cover 16 may be eliminated in this embodiment and a receptacle 152 having a closeable end and a closed end, that is one-piece and integral with the fitted sheet 144, may essentially be the outer cover 16.

Figure 11A:
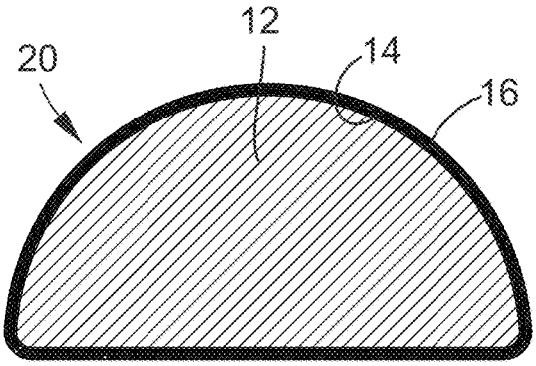
FIG. 11A is a section view of an arch shape for a bumper for any of the embodiments of the present bed bumper apparatus.

As indicated above, FIG. 11A is a section view of an arch shape for a bumper 20 for any of the embodiments of the present bed bumper apparatus, where the bumper 20 includes an arch elongate body 12, an arch inner cover 14, and an arch outer cover 16.

Figure 11B:
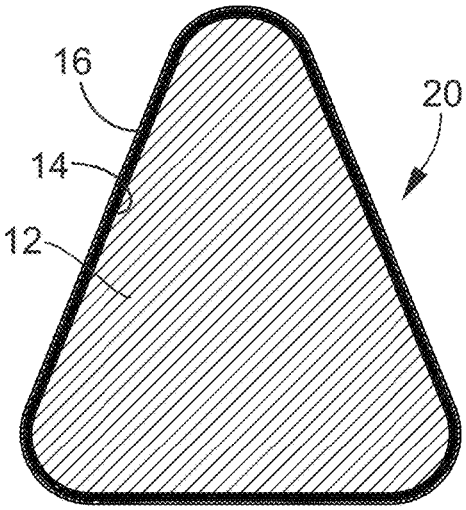
FIG. 11B is a section view of a triangular shape for a bumper for any of the embodiments of the present bed bumper apparatus.

As indicated above, FIG. 11B is a section view of a triangular shape for a bumper 20 for any of the embodiments of the present bed bumper apparatus, where the bumper 20 includes a triangular elongate body 12, a triangular inner cover 14, and a triangular outer cover 16.

Figure 11C:
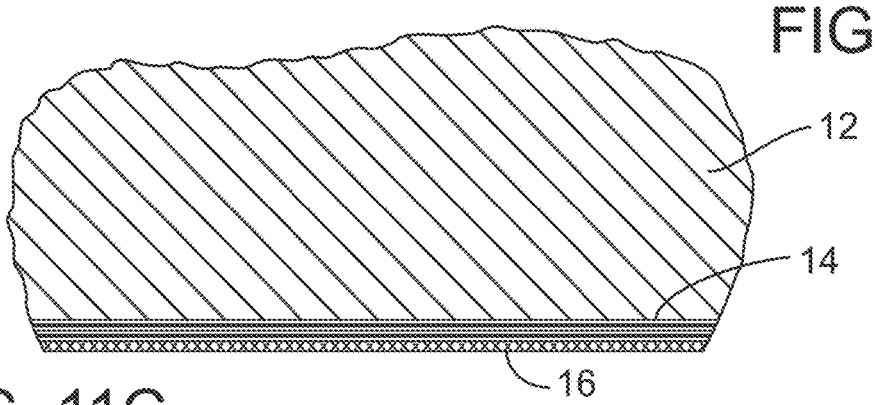
FIG. 11C is section detail view of any of the sides of any of the bumpers of FIGS. 11A, 11B, 11D, and 11E.

As indicated above, FIG. 11C is section detail view of any of the sides of any of the bumpers 20 of FIGS. 11A, 11B, 11D, and 11E or of any of the bumpers 20 of the present bed bumper apparatus.

Figure 11D:
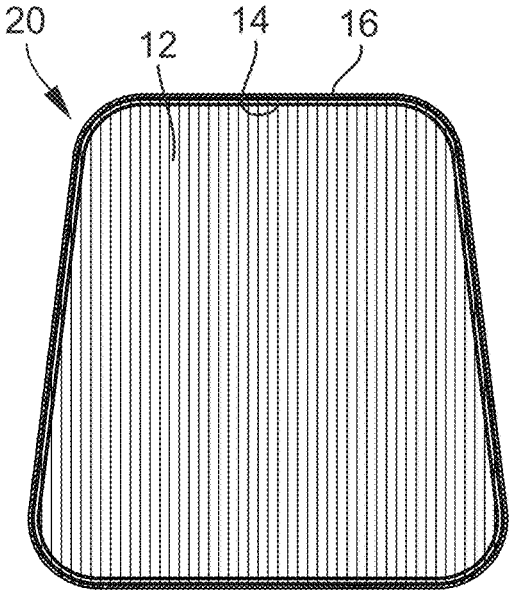
FIG. 11D is a section view of a quadrilateral or four sided or trapezoidal shape for a bumper for any of the embodiments of the present bed bumper apparatus.

As indicated above, FIG. 11D is a section view of a quadrilateral or four sided or trapezoidal shape for a bumper 20 for any of the embodiments of the present bed bumper apparatus, where the bumper 20 includes a trapezoidal elongate body 12, a trapezoidal inner cover 14, and a trapezoidal outer cover 16.

Figure 11E:
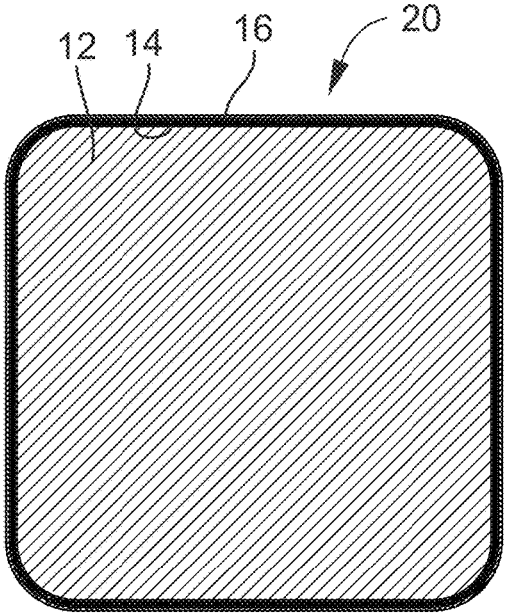
FIG. 11E is a section view of a square or rectangular shape for a bumper for any of the embodiments of the present bed bumper apparatus.

As indicated above, FIG. 11E is a section view of a square or rectangular shape for a bumper 20 for any of the embodiments of the present bed bumper apparatus, where the bumper 20 includes a rectangular elongate body 12, a rectangular inner cover 14, and a rectangular outer cover 16, where adjacent sides are equal. If desired, the rectangular body 12, rectangular inner cover 14, and rectangular outer cover 16 may be rectangular where adjacent sides are unequal.

Figure 12A:
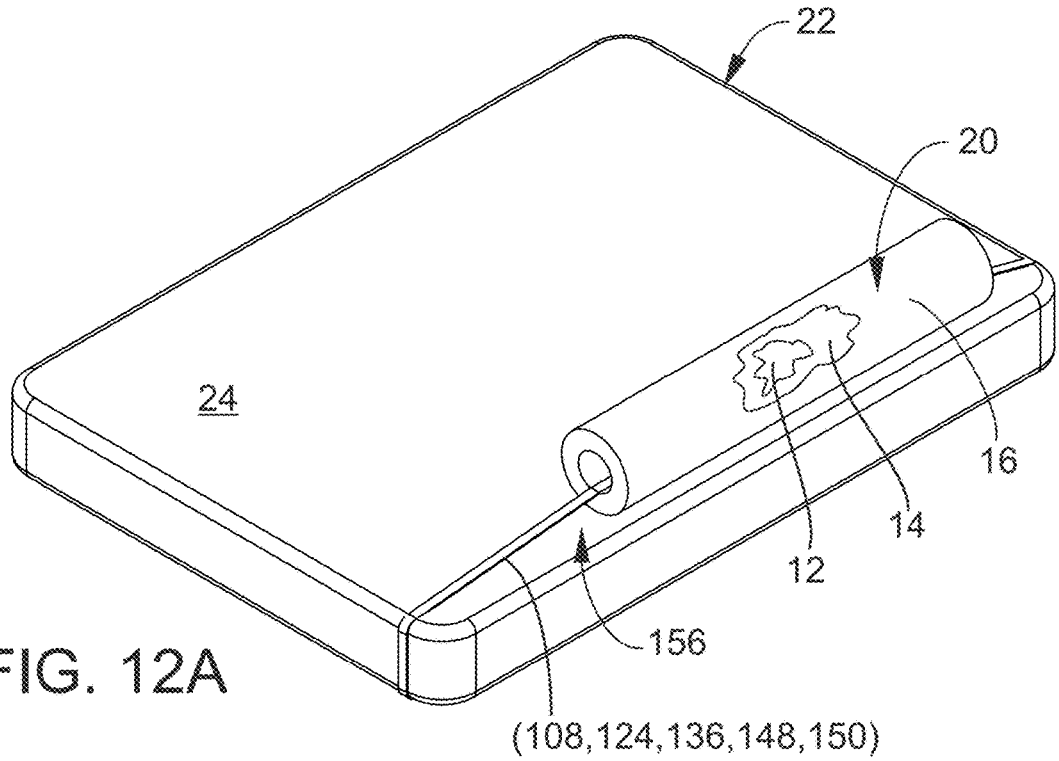
FIG. 12A is a perspective view of an eighth embodiment of the present bed bumper apparatus.
Figure 12B:
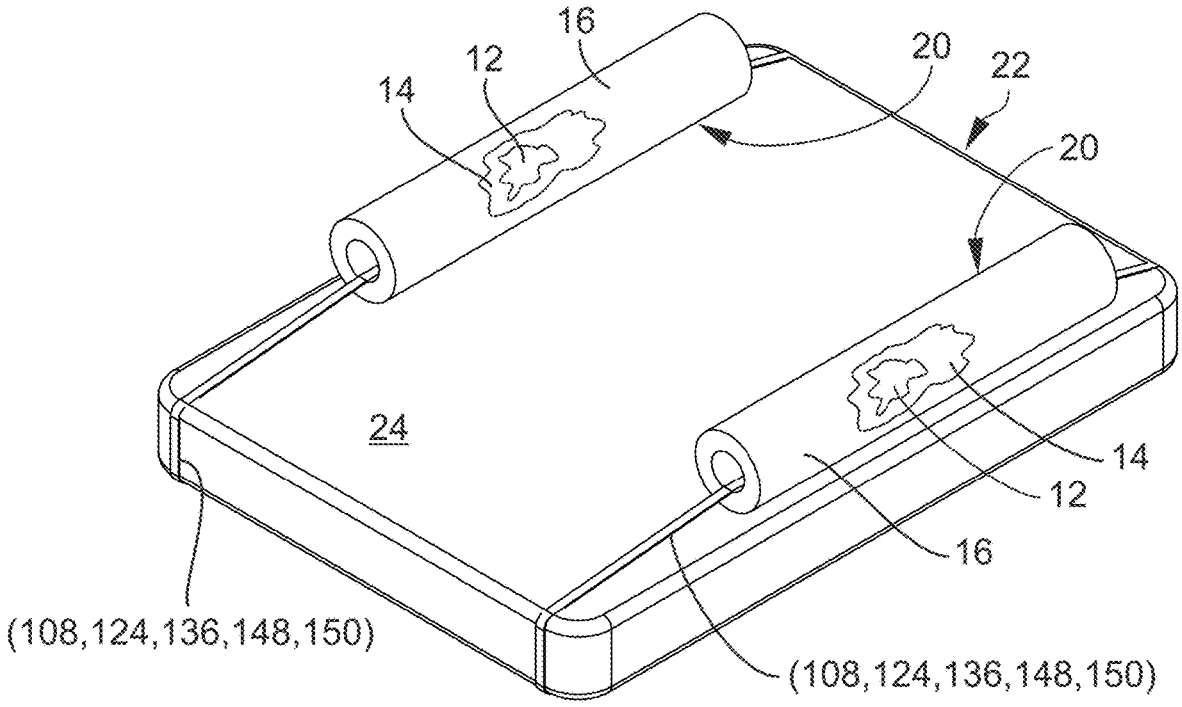
FIG. 12B is a perspective view of the eighth embodiment of FIG. 12A having two opposing bumpers of the bumper of FIG. 12A.

As indicated above, FIG. 12A is a perspective view of an eighth embodiment of the present bed bumper apparatus where the bumper 20 has the shape of a full cylinder and where the cylindrical bumper 20 has a pair of open ends 156. FIG. 12B is a perspective view of the eighth embodiment of FIG. 12A having two opposing bumpers 20 of the bumper 20 of FIG. 12A. In FIGS. 12A and 12B, any of the strap apparatus of the present invention may be employed except strap apparatus 142 (having no wrap around strap), where the strap apparatus that may be employed include strap apparatus (having strap 180), strap apparatus 122 (having strap 124), strap apparatus 134 (having strap 136), strap apparatus 148, and strap apparatus 150. Where straps having two ends are disposed, strap loops 74, 76 may be employed. Where endless straps are employed the endless strap passes through the entire cylindrical bumper 20 of FIGS. 12A, 12B. Where hook strip 138 and loop strip 140 are employed, one of the strips 138, 140 is engaged to the inner surface of the opening of the cylindrical bumper 20 and the other of the strips 138, 140 is engaged to the endless strap. Strap apparatus 142, having no wrap around strap, is not employed.

The cylindrical bumper 20 of FIGS. 12A and 12B includes: a) an elongate cylindrical body 12 that is resilient and flexible, where the elongate cylindrical body 12 includes first and second body ends that are open; b) an inner cylindrical cover 14, where the inner cylindrical cover 14 is flexible, where the inner cylindrical cover 14 encloses an entirety of the elongate cylindrical body 12 such that the elongate cylindrical body 12 is inaccessible to the touch and such that the elongate cylindrical body 12 is removable from the inner cylindrical cover 14 only by destroying an integrity of the inner cylindrical cover 14, where the inner cylindrical cover 14 is tailored to the elongate cylindrical body 12 such that movement of the elongate cylindrical body 12 inside the inner cylindrical cover 14 is minimized, and where the inner cylindrical cover 14, having the elongate cylindrical body 12 therein, includes first and second inner cover ends that are open; and c) an outer cylindrical cover 16, where the outer cylindrical cover 16 is flexible, where the outer cylindrical cover 16 encloses an entirety of the inner cylindrical cover 14 and elongate cylindrical body 12, where the outer cylindrical cover 16 includes first and second outer cover ends 156 that are open, where the outer cylindrical cover 16 is tailored to the inner cylindrical cover 14 having the elongate cylindrical body 12 such that movement of the inner cylindrical cover 14, having the elongate cylindrical body 12 therein, inside of the outer cylindrical cover 16 is minimized. The bed bumper apparatus of FIGS. 12A and 12B further includes a flexible strap forming at least a portion of a loop for engaging the mattress 22, where the loop extends through the outer cylindrical cover 16 having therein the inner cylindrical cover 14 having therein the elongate cylindrical body 12. If desired, bumper 20 of FIGS. 12A and 12B may not include the inner cylindrical cover 14 and the outer cylindrical cover 16 such that the bumper 20 may only include the elongate cylindrical body 12.

One or more of the inner cover 14 and outer cover 16 of any of the embodiments disclosed herein may be formed of a flexible and waterproof fabric, textile, sheeting, vinyl, or polyvinyl chloride (PVC). The elongate body 12 of any of the embodiments disclosed herein may be formed of a polymeric open cell foam or polymeric closed cell foam. The elongate body 12 of any of the embodiments disclosed herein may be formed of a polyurethane foam. The elongate body 12 may be inflatable such that the elongate body 12 may have its own skin or sheeting, which is in turn enclosed by the inner cover 14, which is in turn enclosed by the outer cover 16. The elongate body 12 may include or consist of feathers, pillow material, packing material, peanut packing material, or chopped up foam instead of one-piece foam. If desired, a bumper 20 may be placed longitudinally down a central longitudinal portion of the mattress or down an intermediate longitudinal portion of a mattress to divide the sleeping surface 24 into two sleeping surface portions. The zipper 72 and straps of the various embodiments may be aligned so as to define a plane. The zipper 72 and straps of the various embodiments may be offset from each other.

Instead of the shape of the elongate body 12, inner cover 14, and outer cover 16 being described as being the shape of a circle, such shape may be described as a curved shape, or a tapering shape, a shape without sharp breaks, an arch shape, or an arc shape. However, a preferred shape of a section of the elongate body 12, inner cover 14, and outer cover 16 is a half circle or circular shape.

The bed bumper 20 may be disposed between the mattress 22 and a fitted sheet, such as fitted sheet 144 without a Velcro® strip such as loop strip 140. Such fitted sheet 144 may be a conventional fitted sheet 144 without receptacle 152. Such fitted sheet 144 may or may not be waterproof. If desired the bed bumper 20 may be disposed on top of a sheet, such as a fitted sheet, which in turn is disposed on top of a mattress 22.

Figure 7A:
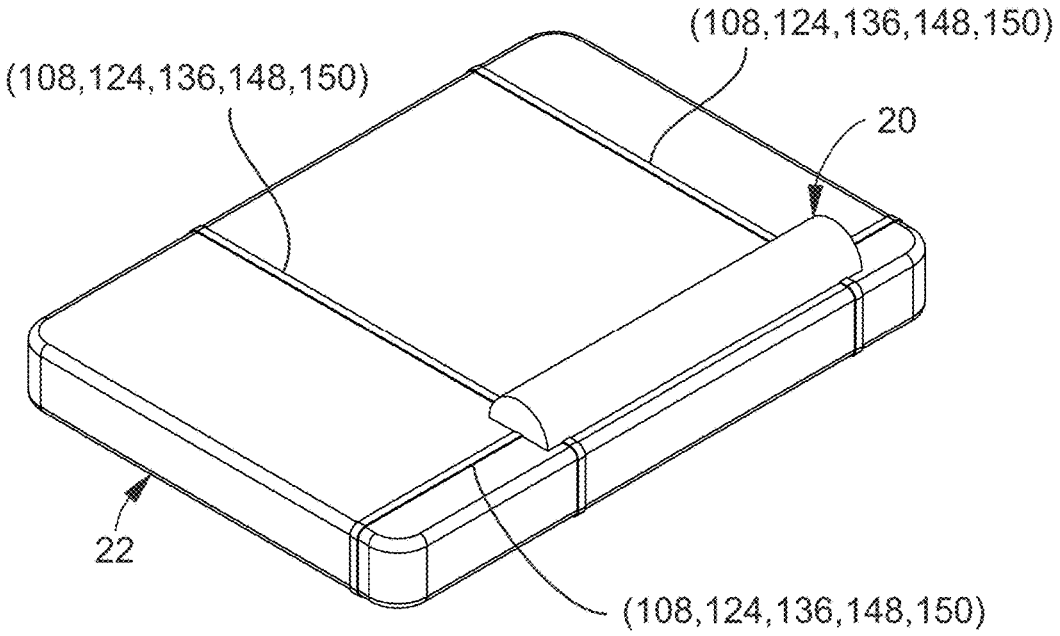
FIG. 7A is a perspective view of the present bed bumper apparatus that may be engaged to a mattress by three straps, where the three straps may be any of the straps disclosed herein.
Figure 7B:
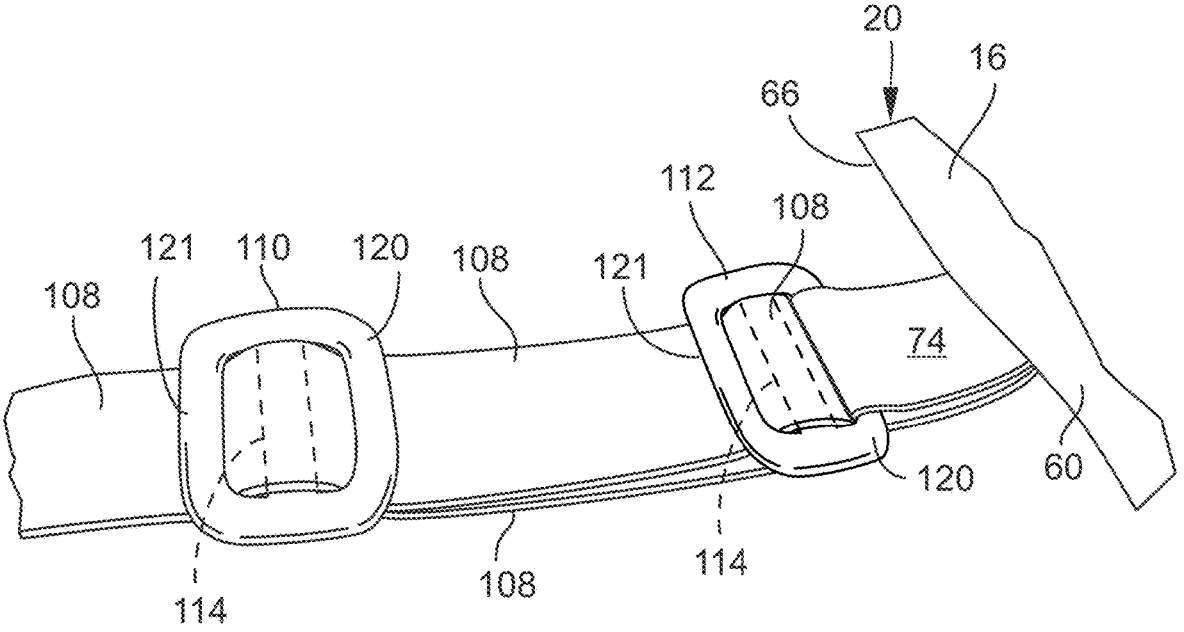
FIG. 7B is a detail of the strap apparatus portion of FIG. 2B.
Figure 13A:
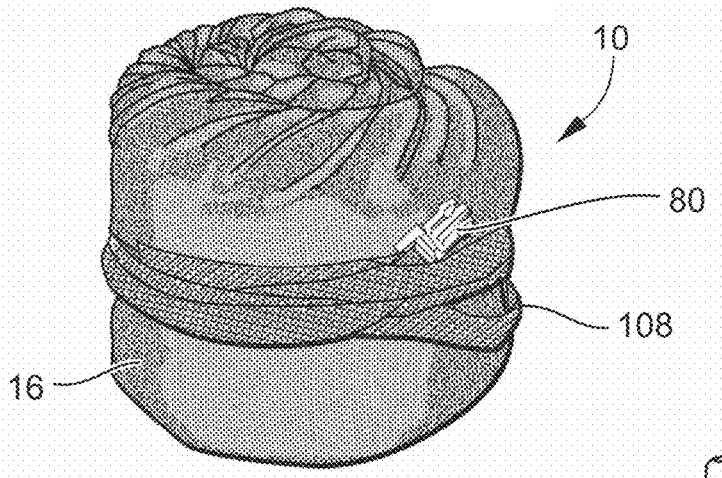
FIG. 13A is a perspective view of the bed bumper apparatus of FIG. 1A in a rolled up and compact form.
Figure 13B:
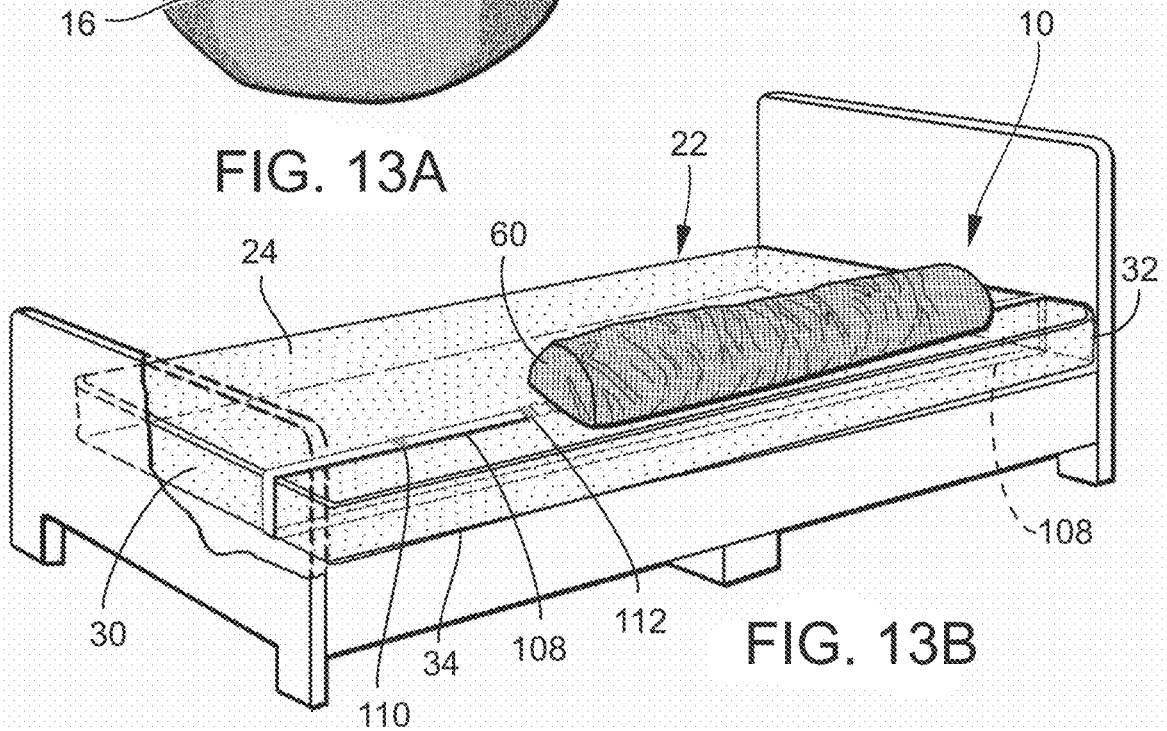
FIG. 13B is a perspective view of the bed bumper apparatus of FIG. 13A on a mattress that is on a mattress support of a bed.
Figure 13C:
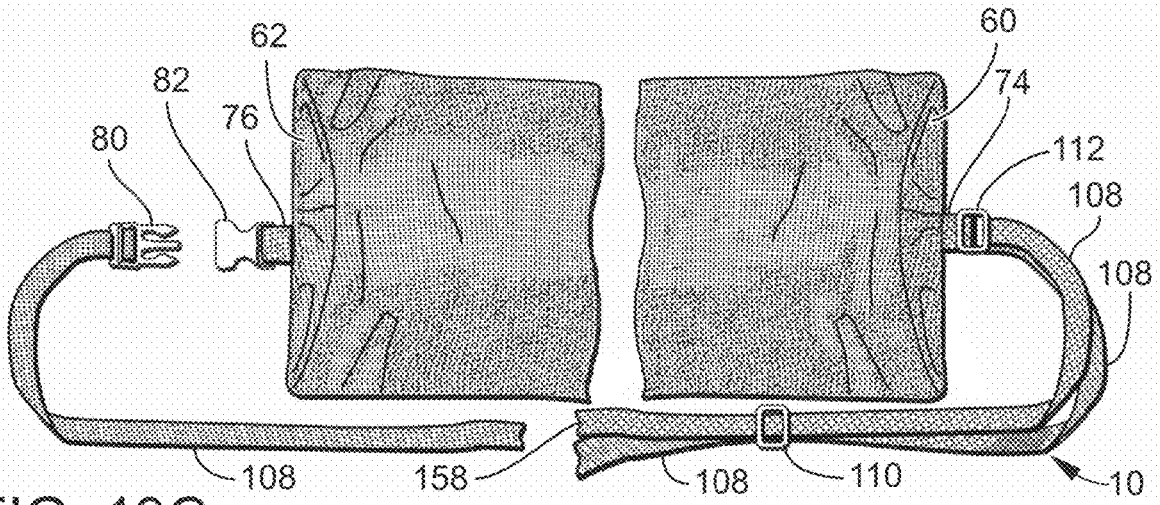
FIG. 13C is a broken apart top view of the bed bumper apparatus of FIG. 13A.
Figures 14A, 14B:
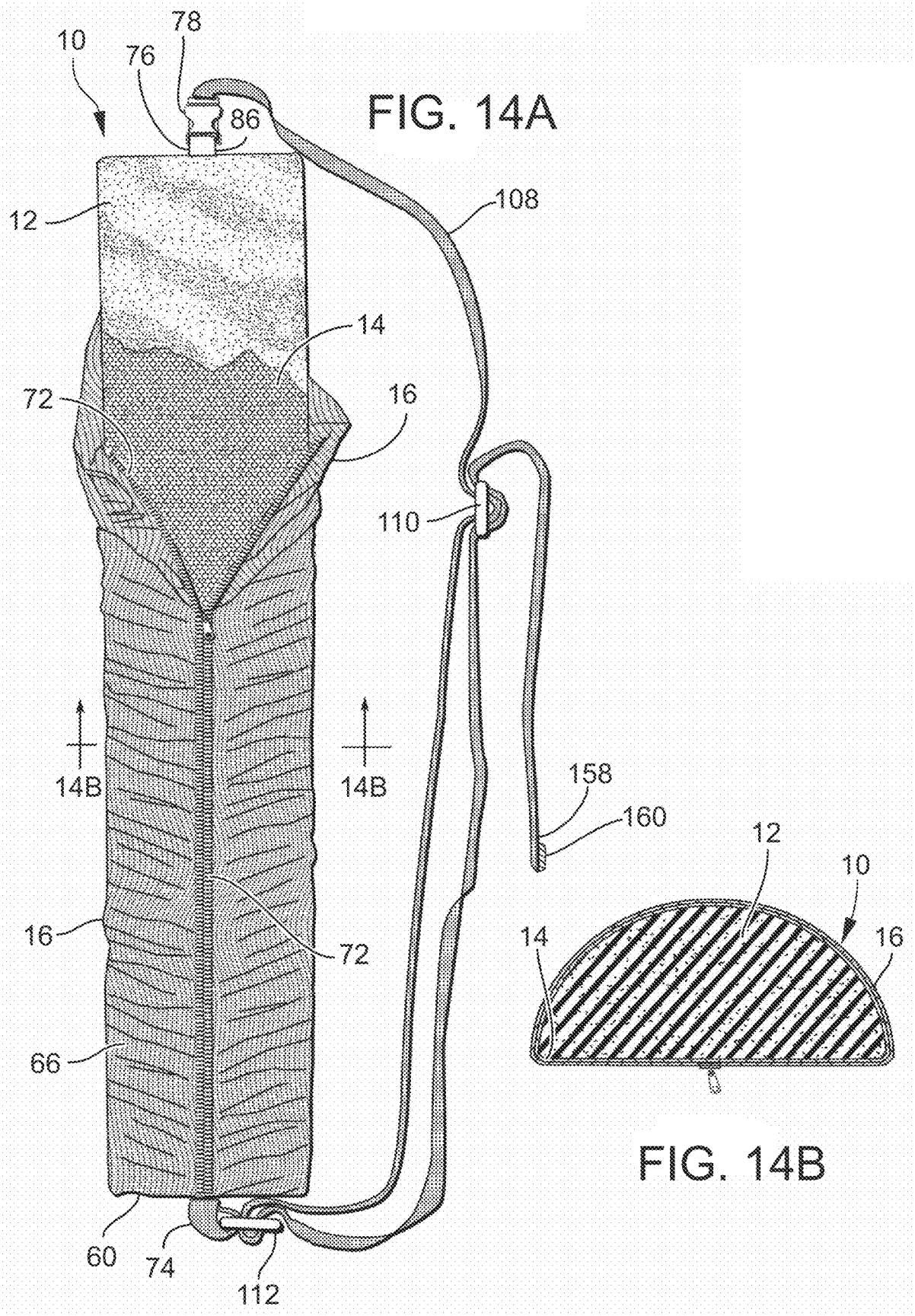
FIG. 14A is a top view of the bed bumper apparatus of FIG. 13A in a rolled out form, where an outer cover is partially unzipped, and where an inner cover is partially cut away to show an elongate foam body.
FIG. 14B is a section at lines 14B-14B of FIG. 14A showing the outer cover, the inner cover, and the foam body of the bed bumper of FIG. 13A.

FIGS. 13A, 13B, 13C, 14A, and 14B show the bed bumper apparatus 10. In these figures, bed bumper apparatus 10 is identical to the bed bumper apparatus 10 shown in FIGS. 1A, 1B, 1C, 2A, 2B, 2C, 2D, 2E, 7B, and 11A, except that bed bumper strap apparatus 18 in FIGS. 13A, 13B, 13C, 14A, and 14B has a free end portion 158, as shown in FIG. 14A, while the bed bumper strap apparatus 18 in FIG. 7B includes an end that is looped about post 114 of buckle 110.

As shown in FIG. 14A, flexible strap apparatus 18 includes first and second nonelastic strap ends or nonelastic strap loops 74, 76. The first strap end 74 is engaged to the junction of the first outer cover end 60 of the outer cover 16 and bottom 66 of the outer cover 16. The second strap end 76 is engaged to the junction of the second outer cover end 62 and the bottom 66. The strap apparatus 18 is separable into two strap portions by a quick release buckle 78 having a male portion 80 and a female portion 82. Female portion 82 includes the post 84 for engaging strap end 76 or strap loop 76. Strap loop 76 is a strap section 86 that includes an end that is engaged to the junction of cover end 62 and bottom 66, which strap section 86 then extends from such junction, about post 84, and then returns to such junction where a second end of the strap section 86 is engaged to such junction. Female portion 82 includes the pair of opposing indents 88, the pair of opposing prong catching edges 90, the female opening 92, and the stop 94. Male portion 80 includes the pair of opposing prongs 96, with each of the prongs 96 having the catch 98 that catches prong catch edge 90 of the female portion 82. Male portion 80 further includes the pair of opposing stops 100 and the post 102.

As shown in FIG. 14A, strap apparatus 18 further includes the nonelastic strap portion 108 that includes an end that is looped about post 102 of male portion 80. From male portion 80 and loop 76, strap portion 108 as a whole extends, as shown in FIG. 13B, over the mattress sleeping surface 24, down the mattress head end side 32, across the mattress bottom 34, up the mattress foot end side 30, and back across the mattress sleeping surface 24 to loop 74 that is shown in FIG. 14A.

As shown in FIG. 14A, on its journey from loop 76, strap portion 108 first encounters buckle 110, whereupon strap portion 108 extends upwardly through slot 116 of buckle 110, over or about post 114 of buckle 110, and downwardly through slot 118 of buckle 110, and then proceeds out of buckle 110. From buckle 110, strap portion 108 proceeds to buckle 112, whereupon strap portion 108 extends upwardly through slot 118 of buckle 112, over or about post 114 of buckle 112, and downwardly through slot 116 of buckle 112. From buckle 112, strap portion 108 proceeds back to buckle 110, whereupon strap portion 108 extends upwardly through slot 118 of buckle 110 and between another section of strap portion 108 and post 120, over or about post 114 of buckle 110 and on top of another section of strap portion 108, and downwardly out of slot 116 of buckle 110 and between another section of strap portion 108 and post 121. From buckle 112, strap portion 108 extends to the nonelastic free end portion 158. Free end portion 158 includes an absolute nonelastic terminal end 160 having a double strap layer such that the terminal end 160 has a greater width than width of slot 116 and a greater width than the width of slot 118 such that terminal end 160 must be squeezed or pinched to pass through slot 116 and slot 118. The width of slot 118 is a direction parallel to the length of strap portion 108, which is a direction perpendicular to a lateral length of posts 114, 120, and 121. The width of the terminal end 160 is a direction perpendicular to the plane of the strap portion 108.

Strap apparatus 18 of FIG. 14A, including strap portion 108 of FIG. 14A, buckle 110 of FIG. 14A, and buckle 112 of FIG. 14A in combination can be referred to as a length adjustor. Utilizing such buckles 110, 112, the strap portion 108 is adjustable in length such that the strap portion 108 can be fixed at a first length at one time and fixed at a second length at another time. Engaging strap portion 108 as indicated above with respect to FIG. 14A with buckles 112, 110 is a friction fit that can be tightened and loosened. When loosened, buckle 110 of FIG. 14A can be drawn relatively to and away from buckle 112 of FIG. 14A. When the buckle 110 of FIG. 14A is drawn away from buckle 112 of FIG. 14A, the length of the upper and lower sections of the strap portion between buckles 110, 112 of FIG. 14A increases, thereby decreasing the effective length of strap apparatus 18 and thereby tightening the strap apparatus 18 about the mattress 22.

The elongate body 12, the portion of the bed bumper apparatus 10 that is resilient, has a length that is about 30% of the length of the strap portion 108 or about 30% of the length of the strap portion 108 plus the length of buckle 78 plus the length of strap end 76 plus the length of strap end 74. The combined length of the buckle 78, strap end 76, and strap end 74 is not significant.

Preferably, the elongate body 12, the portion of the bed bumper apparatus 10 that is resilient, has a length that is preferably between about 20% and about 40% of the length of the strap portion 108. More preferably, the elongate body 12, the portion of the bed bumper apparatus 10 that is resilient, has a length that is preferably between about 22% and about 38% of the length of the strap portion 108. Still more preferably, the elongate body 12, the portion of the bed bumper apparatus 10 that is resilient, has a length that is preferably between about 25% and about 35% of the length of the strap portion 108. The length of the strap portion 108, or the length of the combination of the strap 108, strap loops 74, 76, buckle 110, 112, and connector buckle 78, which may be defined as a flexible elongate strip, runs from the first end of the strip that is attached to the outer cover 16 to the second end of the strip that is attached to the outer cover 16. Such length is measured along the flexible elongate strip and such length is the same whether the flexible elongate strip is set out in a straight form or whether the flexible elongate strip is set out in an irregular form. The difference between the length of the strip and the length of the strap portion 108 is insignificant.

The length of the strap portion 108 means the length from buckle 78, to buckle 110, to buckle 112, back to buckle 110, and then to the terminal end 160.

The length of the strap portion 108 is of sufficient length to extend about a mattress in the length direction minus the length of the elongate body 12, the portion of the bed bumper apparatus 10 that is resilient.

The minimum length of the strap portion 108 is of sufficient length to extend a point on the mattress top 24, to the mattress head end 32, to the mattress bottom 34, to the mattress foot end 30, and back to such point on the mattress top 24 minus the length of the elongate body 12, the portion of the bed bumper apparatus 10 that is resilient. This minimum length is where buckles 110 and 112 are adjacent to each other and where terminal end 160 is adjacent to buckle 110.

A preferred length of the strap portion 108 is where the elongate body 12, the portion of the bed bumper apparatus 10 that is resilient, has a length that is between about 20% and about 40% of the length of the strap portion 108. This length provides an elongate body 12 that is neither too long nor too short and permits the length adjustment mechanism, i.e., buckles 110 and 112, to provide a sufficient length to the strap portion 108 such that strap portion 108 and bed bumper apparatus 10 may be engaged to a variety of mattress sizes without an unduly long free end portion 158, i.e., the section of strap portion 108 that is between buckle 110 and the terminal end 160.

The elongate body 12, the portion of the bed bumper apparatus 10 that is resilient, preferably terminates short of the head end 32 of the mattress 22 and, at the same time, preferably terminates short of the foot end 30. The elongate body 12, the portion of the bed bumper apparatus 10 that is resilient, preferably is spaced from the head end 32 of the mattress 22 and, at the same time, preferably is spaced from the foot end 30.

FIG. 13A shows the bed bumper apparatus 10 in a rolled up form. The elongate body 12, which is the portion of the bed bumper apparatus 10 that is resilient, is resilient in each of the x, y, and z axis directions. The sides of the elongate body 12 can be squeezed together, which sides then spring back to the original unsqueezed position. The top and bottom surfaces of the elongate body 12 can be squeezed together, which top and bottom surfaces then spring back to the original unsqueezed position. The ends of the elongate body 12 can be drawn together resiliently and then, upon release, spring back outwardly to the positions the ends were in prior to being drawn in together. Also, as shown in FIG. 13A, elongate body 12, including the inner and outer covers 14, 16 can be rollable into the rolled up form whereupon the strap apparatus 18 can be wrapped about the rolled up form to keep the elongate body 12 and the inner and outer covers 14, 16 in the rolled up form. Upon an unwrapping of the strap apparatus 18, the elongate body 12 and the inner and outer covers 14, 16 unroll automatically to the straight form shown in FIG. 13B or to a slightly curved or arc form. If the elongate body 12 and inner and outer covers 14, 16 take the slightly curved or arc form, a tensioned engagement of the strap portion 108 about the mattress 22 and to the strap loops 74, 76 draws out the elongate body 12 and inner and outer covers 14, 16 to the straight form that is shown in FIG. 13B.

As shown in FIG. 13B, in a preferred arrangement, the length of the strap portion 108 is such so that the buckle 110 lies on the top surface of the mattress 22. Buckle 112 always lies on the top surface of the mattress 22 since the buckle 112 is engaged at a set distance from end 60 of the bed bumper apparatus 10 by the nonadjustable strap loop 74 and since end 60 is preferably spaced from foot mattress end 30.

FIG. 13C shows an exploded view of the bed bumper apparatus 10. The entire bed bumper apparatus 10 is flexible including the strap apparatus 18, except for buckles 112, 110, and 78. Buckle 78 includes the male portion 80 and the female portion 82.

FIG. 14A shows a bottom view of the bed bumper apparatus 10 and shows that the length of the elongate body 12 is between about 20% and about 40% of the length of the strap portion 108. Zipper 72 is shown in FIG. 14A. FIG. 1B shows that the zipper 72 runs from end 60 to end 62.

FIG. 14B is a section view at lines 14B-14B of FIG. 14A. FIG. 14B shows that the elongate resilient body 12 is completely enclosed by the inner cover 14 that is in turn completely enclosed by the outer cover 16.

The strap apparatus 18 of FIGS. 13A, 13B, 13C, 14A, and 14B, including strap portion 108, strap loops 74, 76, quick release buckle 78, buckles 110, 112, free end portion 158, and terminal end 160, or any portion thereof, may be employed with any of the other bed bumper apparatus disclosed herein, including straps 124, 136, 148, and 150, and including the arrangements shown in FIGS. 7A, 8A, 8B, 9A, 9B, 12A, and 12B.

One invention herein includes a bed bumper apparatus, that includes: a) an elongate body that is resilient and flexible, the elongate body having first and second body ends; b) an inner cover, the inner cover being flexible, the inner cover enclosing an entirety of the elongate body such that the elongate body is inaccessible to the touch and such that the elongate body is removable from the inner cover only by destroying an integrity of the inner cover; c) an outer cover, the outer cover being flexible, the outer cover enclosing an entirety of the inner cover and elongate body, the outer cover having first and second outer cover ends; d) a flexible elongate strip engagable to the outer cover for engaging the outer cover, having the inner cover and elongate body therein, to a mattress. Such invention may further include the elongate body in section including the shape of a triangle, a trapezoid, or a rectangle, where the rectangle includes adjacent sides that are equal in length. Such invention may further include the flexible elongate strip including a strap, where the strap forms at least a portion of a loop, and where the strap is elastic. Such invention may further include the flexible elongate strip including a strap, where the strap forms at least a portion of a loop, and where at least a portion of the strap is elastic. Such invention may further include a fitted sheet for engaging a mattress, where the fitted sheet includes a quick release strip, where the outer cover includes a bottom, where the flexible elongate strip is engaged to the bottom, where the flexible elongate strip is engaged to the quick release strip by a connection, where the connection is a quick release connection.

Another invention herein includes a bed bumper apparatus that includes: a) an elongate body that is resilient and flexible, the elongate body having first and second body ends; b) an inner cover, the inner cover being flexible, the inner cover enclosing an entirety of the elongate body such that the elongate body is inaccessible to the touch and such that the elongate body is removable from the inner cover only by destroying an integrity of the inner cover; c) an outer cover, the outer cover being flexible, the outer cover enclosing an entirety of the inner cover and elongate body, the outer cover having first and second outer cover ends; and d) a fitted sheet for a mattress, the fitted sheet having a receptacle for the outer cover having the inner cover having the elongate body, the receptacle tailored to fit the shape of the outer cover having the inner cover having the elongate body such that movement of the outer cover having the inner cover having the elongate body is minimized in the receptacle.

Another invention herein includes a bed bumper apparatus that includes: a) an elongate cylindrical body that is resilient and flexible, the elongate cylindrical body having first and second body ends that are open; b) an inner cylindrical cover, the inner cylindrical cover being flexible, the inner cylindrical cover enclosing an entirety of the elongate cylindrical body such that the elongate cylindrical body is inaccessible to the touch and such that the elongate cylindrical body is removable from the inner cylindrical cover only by destroying an integrity of the inner cylindrical cover, the inner cylindrical cover being tailored to the elongate cylindrical body such that movement of the elongate cylindrical body inside the inner cylindrical cover is minimized, the inner cylindrical cover, having the elongate cylindrical body therein, having first and second inner cover ends that are open; and c) an outer cylindrical cover, the outer cylindrical cover being flexible, the outer cylindrical cover enclosing an entirety of the inner cylindrical cover and elongate cylindrical body, the outer cylindrical cover having first and second outer cover ends that are open, the outer cylindrical cover being tailored to the inner cylindrical cover having the elongate cylindrical body such that movement of the inner cylindrical cover, having the elongate cylindrical body therein, inside of the outer cylindrical cover is minimized. Such invention may further include a flexible strap forming at least a portion of a loop for engaging a mattress, the loop extending through the outer cylindrical cover having therein the inner cylindrical cover having therein the elongate cylindrical body.

Another invention includes a bed bumper and mattress combination that includes: a) an elongate body that is resilient and flexible, the elongate body having first and second body ends; b) an inner cover, the inner cover being flexible, the inner cover enclosing an entirety of the elongate body such that the elongate body is inaccessible to the touch and such that the elongate body is removable from the inner cover only by destroying an integrity of the inner cover; c) an outer cover, the outer cover being flexible, the outer cover enclosing an entirety of the inner cover and elongate body, the outer cover having first and second outer cover ends; d) a first flexible strap apparatus engaged to the bed bumper and mattress and having a first strap extending about the mattress that defines a first plane and that minimizes lateral movement of the outer cover; e) a second flexible strap apparatus engaged to the bed bumper and mattress and having a second strap extending about the mattress that defines a second plane and that minimizes longitudinal movement of the outer cover; and f) the first and second planes being at a right angle to each other such that each of lateral and longitudinal movement of the outer cover, inner cover, and elongate body is minimized. Such invention may further include a third strap apparatus engaged to the bed bumper and mattress and having a third strap extending about the mattress that defines a third plane and that minimizes lateral movement of the outer cover, the third plane being parallel to the first plane. Such invention may further include each of the first and third strap apparatus engaging an end portion of the outer cover.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A bed bumper apparatus, comprising:

a) an elongate body that is resilient and flexible, the elongate body having first and second body ends, the elongate body having a bottom surface, the bottom surface defining a plane and extending to and between the first and second body ends, the bottom surface having first and second side edges that are spaced apart, the elongate body having a top surface, the top surface defining a half-circle, the top surface extending to and between the first and second body ends, the top surface extending to and between the first and second side edges of the bottom surface such that the elongate body in section defines a shape of a half circle with a plane bottom, wherein:

i) the elongate body is resilient in each of the x, y, and z directions;

ii) the elongate body is squeezable such that sides of the elongate body can be squeezed together, which sides are springable back to an original unsqueezed position;

iii) the elongate body is squeezable such that the top and bottom surfaces can be squeezed together, which top and bottom surfaces are springable back to an original unsqueezed position;

iv) the first and second body ends are drawable together and, upon release, springable back outwardly to a position that the first and second body ends were in prior to being drawn together; and v) the elongate body being rollable up to have a rolled up form;

b) an inner cover, the inner cover being flexible, the inner cover enclosing an entirety of the elongate body such that the elongate body is removable from the inner cover only by destroying an integrity of the inner cover, the inner cover being tailored to the elongate body such that movement of the elongate body inside the inner cover is minimized;

c) an outer cover, the outer cover being flexible, the outer cover enclosing an entirety of the inner cover and elongate body, the outer cover having first and second outer cover ends, the outer cover being tailored to the inner cover having the elongate body such that movement of the inner cover, having the elongate body therein, inside of the outer cover is minimized, the outer cover having a bottom portion adjacent to the bottom surface of the elongate body, the outer cover having an elongate opening in the bottom portion of the outer cover and extending between the first and second outer cover ends, the elongate opening having a length and being incrementally openable and closeable along the length such that the inner cover having the elongate body is removable from the outer cover, wherein the outer cover includes:

i) a zipper that opens and closes the elongate opening of the bottom portion of the outer cover that extends to and between the first and second outer cover ends;

ii) first and second side edge portions that are adjacent to the first and second side edges of the bottom of the elongate body;

iii) the zipper being disposed between the first and second side edge portions of the outer cover and on the bottom portion of the outer cover; and iv) the zipper having first and second ends; and d) a flexible strap apparatus having first and second strap ends, the first strap end engaged to the first outer cover end, the second strap end engaged to the second outer cover end, the strap apparatus being separable into two strap portions by a quick release buckle, the strap apparatus being adjustable in length such that the strap apparatus can be fixed at a first length at one time and fixed at a second length at another time, wherein the flexible strap apparatus includes:

i) the first strap end including a first strap loop, the first strap loop being adjacent to the first end of the zipper;

ii) the second strap end including a second strap loop, the second strap loop being adjacent to the second end of the zipper;

iii) the first strap loop engaging a first portion of the quick release buckle;

iv) the first portion of the quick release buckle engaging a second portion of the quick release buckle;

v) the second portion of the quick release buckle engaging a first strap portion;

vi) the first strap portion extending from the second portion of the quick release buckle to a first buckle where the first strap portion engages the first buckle;

vii) a second strap portion extending from the first strap portion and further extending from the first buckle to a second buckle where the second strap portion engages the second buckle;

viii) the second buckle being engaged to the second strap loop;

ix) a third strap portion extending from the second strap portion and further extending from the second buckle to the first buckle where the third strap portion engages the first buckle;

x) a fourth strap portion extending from the third strap portion and further extending from the first buckle to a strap free end, the strap free end having a double strap layer;

xi) the quick release buckle being adjacent to the first end of the zipper and to the elongate body; and xii) the second buckle being adjacent to the second end of the zipper and to the elongate body;

e) wherein the bed bumper apparatus includes a bed bumper and the flexible strap apparatus, the bed bumper including an outermost portion;

f) wherein the bed bumper includes the elongate body, the inner cover, and the outer cover;

g) wherein the outer cover in section defines a half-circle with a plane bottom;

h) wherein the outer cover is the outermost portion of the bed bumper such that the outermost portion of the bed bumper defines a half-circle with a plane bottom;

i) the outer cover being adjacent to the inner cover about an entirety of the inner cover, and the outer cover being adjacent to the elongate body about an entirety of the elongate body;

j) the first strap end engaged to the first outer cover end at a location adjacent to the elongate body, the second strap end engaged to the second outer cover end at a location adjacent to the elongate body;

k) the bottom portion of the outer cover being the bottommost portion of the outer cover such that the zipper is disposed on the bottommost portion of the outer cover; and l) wherein the first strap portion is integral with the second strap portion that is integral with the third strap portion that is integral with the fourth strap portion.

2. A bed bumper apparatus, comprising:

a) an elongate body that is resilient and flexible, the elongate body having first and second body ends, the elongate body having a bottom surface, the bottom surface defining a plane and extending to and between the first and second body ends, the bottom surface having first and second side edges that are spaced apart, the elongate body having a top surface, the top surface defining a circular shape, the top surface extending to and between the first and second body ends, the top surface extending to and between the first and second side edges of the bottom surface such that the elongate body in section defines an upper circular shape with a plane bottom, wherein:

i) the elongate body is resilient in each of the x, y, and z directions;

ii) the elongate body is squeezable such that sides of the elongate body can be squeezed together, which sides are springable back to an original unsqueezed position;

iii) the elongate body is squeezable such that the top and bottom surfaces can be squeezed together, which top and bottom surfaces are springable back to an original unsqueezed position;

iv) the first and second body ends are drawable together and, upon release, springable back outwardly to a position that the first and second body ends were in prior to being drawn together; and v) the elongate body being rollable up to have a rolled up form;

b) an inner cover, the inner cover being flexible, the inner cover enclosing an entirety of the elongate body such that the elongate body is removable from the inner cover only by destroying an integrity of the inner cover, the inner cover being tailored to the elongate body such that movement of the elongate body inside the inner cover is minimized;

c) an outer cover, the outer cover being flexible, the outer cover enclosing an entirety of the inner cover and elongate body, the outer cover having first and second outer cover ends, the outer cover being tailored to the inner cover having the elongate body such that movement of the inner cover, having the elongate body therein, inside of the outer cover is minimized, the outer cover having a bottom portion adjacent to the bottom surface of the elongate body, the outer cover having an elongate opening in the bottom portion of the outer cover and extending between the first and second outer cover ends, the elongate opening having a length and being incrementally openable and closeable along the length such that the inner cover having the elongate body is removable from the outer cover, wherein the outer cover includes:

i) a zipper that opens and closes the elongate opening of the bottom portion of the outer cover that extends to and between the first and second outer cover ends;

ii) first and second side edge portions that are adjacent to the first and second side edges of the bottom of the elongate body;

iii) the zipper being disposed between the first and second side edge portions of the outer cover and on the bottom portion of the outer cover; and iv) the zipper having first and second ends; and d) a flexible strap apparatus having first and second strap ends, the first strap end engaged to the first outer cover end, the second strap end engaged to the second outer cover end, the strap apparatus being separable into two strap portions by a quick release buckle, the strap apparatus being adjustable in length such that the strap apparatus can be fixed at a first length at one time and fixed at a second length at another time, wherein the flexible strap apparatus includes:

i) the first strap end including a first strap loop, the first strap loop being adjacent to the first end of the zipper;

ii) the second strap end including a second strap loop, the second strap loop being adjacent to the second end of the zipper;

iii) the first strap loop engaging a first portion of the quick release buckle;

iv) the first portion of the quick release buckle engaging a second portion of the quick release buckle;

v) the second portion of the quick release buckle engaging a first strap portion;

vi) the first strap portion extending from the second portion of the quick release buckle to a first buckle where the first strap portion engages the first buckle;

vii) a second strap portion extending from the first strap portion and further extending from the first buckle to a second buckle where the second strap portion engages the second buckle;

viii) the second buckle being engaged to the second strap loop;

ix) a third strap portion extending from the second strap portion and further extending from the second buckle to the first buckle where the third strap portion engages the first buckle;

x) a fourth strap portion extending from the third strap portion and further extending from the first buckle to a strap free end, the strap free end having a double strap layer;

xi) the quick release buckle being adjacent to the first end of the zipper and to the elongate body; and xii) the second buckle being adjacent to the second end of the zipper and to the elongate body;

e) wherein the bed bumper apparatus includes a bed bumper and the flexible strap apparatus, the bed bumper including an outermost portion;

f) wherein the bed bumper includes the elongate body, the inner cover, and the outer cover;

g) wherein the outer cover in section defines an upper circular shape with a plane bottom;

h) wherein the outer cover is the outermost portion of the bed bumper such that the outermost portion of the bed bumper defines an upper circular shape with a plane bottom;

i) the outer cover being adjacent to the inner cover about an entirety of the inner cover, and the outer cover being adjacent to the elongate body about an entirety of the elongate body;

j) the first strap end engaged to the first outer cover end at a location adjacent to the elongate body, the second strap end engaged to the second outer cover end at a location adjacent to the elongate body;

k) the bottom portion of the outer cover being the bottommost portion of the outer cover such that the zipper is disposed on the bottommost portion of the outer cover; and l) wherein the first strap portion is integral with the second strap portion that is integral with the third strap portion that is integral with the fourth strap portion.

* * * * *